United States Patent [19]

Gotoh et al.

[11] Patent Number: 4,781,224

[45] Date of Patent: Nov. 1, 1988

[54] LOOM EQUIPPED WITH WEFT PICKING CONTROL SYSTEM

[75] Inventors: Miyuki Gotoh, Tokyo; Mitugu Kawajiri, Iruma; Hiroshi Kobayashi, Tokyo, all of Japan

[73] Assignee: Nissan Motor Co., Ltd., Yokohama, Japan

[21] Appl. No.: 756,448

[22] Filed: Jul. 18, 1985

[30] Foreign Application Priority Data

| | | | |
|---|---|---|---|
| Jul. 20, 1984 | [JP] | Japan | 59-149663 |
| Nov. 9, 1984 | [JP] | Japan | 59-235226 |
| Jan. 10, 1985 | [JP] | Japan | 60-1497 |
| Jan. 10, 1985 | [JP] | Japan | 60-894[U] |

[51] Int. Cl.[4] ..... D03D 47/30; D03D 47/36

[52] U.S. Cl. ..... 139/435; 139/452

[58] Field of Search ..... 139/450, 452, 435, 370.2

[56] References Cited

U.S. PATENT DOCUMENTS

| | | | |
|---|---|---|---|
| 3,678,969 | 7/1972 | Gotoh | 139/370.1 |
| 4,378,821 | 4/1983 | Umezawa | 139/452 |
| 4,407,336 | 10/1983 | Steiner | 139/452 |
| 4,446,893 | 5/1984 | Gunnemann et al. | 139/11 |
| 4,458,726 | 7/1984 | Wenig | 139/435 |
| 4,463,783 | 8/1984 | Suzuki et al. | 139/435 |
| 4,471,817 | 9/1984 | Browwee et al. | 139/452 |
| 4,595,039 | 6/1986 | Tholander | 242/47.01 |

FOREIGN PATENT DOCUMENTS

| | | | |
|---|---|---|---|
| 105561 | 4/1984 | European Pat. Off. | 139/435 |
| 2716282 | 10/1978 | Fed. Rep. of Germany | 139/21 |
| 22190 | 6/1971 | Japan | 139/470.2 |
| 125941 | 7/1984 | Japan | 139/435 |
| 47449 | 3/1985 | Japan | 139/435 |
| 162839 | 8/1985 | Japan | 139/435 |
| 162837 | 8/1985 | Japan | 139/435 |
| 1023009 | 6/1983 | U.S.S.R. | 139/370.2 |

OTHER PUBLICATIONS

Russian Document #632773, Date: Nov. 15, 1978, Title: Weft metering System for Pneumatic Loom–Determines the Frequency of Excess Length Feeding, to Correct Your Tension, 2 pp. of specification.

*Primary Examiner*—Harvey C. Hornsby
*Assistant Examiner*—Joseph S. Machuga
*Attorney, Agent, or Firm*—Foley & Lardner, Schwartz, Jeffery, Schwaab, Mack, Blumenthal & Evans

[57] ABSTRACT

A loom is provided with a weft inserting nozzle for picking a weft yarn under the influence of fluid jet and equipped with a weft picking control system which consists of a device for detecting the tension of the picked weft yarn at a timing of termination of travel of the weft yarn in weft picking. The thus detected weft yarn tension is compared with a standard tension by a comparing device forming part of a control circuit thereby to obtain the difference therebetween. The pressure of air to be supplied to the weft inserting nozzle is controlled in accordance with the difference in tension, thus maintaining the weft yarn tension at a constant value.

23 Claims, 25 Drawing Sheets

LOOM EQUIPPED WITH WEFT PICKING CONTROL SYSTEM

BACKGROUND OF THE INVENTION

1. Field of the Invention

This invention relates generally to an improvement in a loom equipped with a weft picking control system, and more particularly to the weft picking control system arranged to control the operation of the loom in accordance with the discrepancy between actual force of a picked weft yarn and a standard force thereby to maintain weft picking in a suitable condition.

2. Description of the Prior Art

A variety of weft picking control systems of looms have been proposed to attain good weft picking. One of these is disclosed, for example, in U.S. Pat. No. 4,446,893 entitled "Method for Transporting a Weft Thread through the Weaving Shed of a Weaving Machine through the Intermediary of a Flowing Fluid, and Weaving Machine adapted for the Application of this Method". The weft picking control system in this U.S. patent is arranged as follows: A weft yarn is picked into the shed of warp yarns under the influence of transporting fluid ejected from a plurality of nozzles, in which the transporting speed or time of the picked weft yarn is measured by detecting a timing at which the tip end of the weft yarn reaches an anti-weft picking side from a timing of starting of weft picking. The revolution speed of a main shaft of the loom or the transporting speed of the weft yarn is controlled in such a manner that the measured time occupies a predetermined fraction of time in a weaving cycle. This is effective for reducing mispick.

Here, it is to be noted that, in order to improve the quality of woven cloths, it is required to uniformalize the tension of weft yarns and the tension of warp yarns. This for the warp yarn can be met mainly by high performance control of feeding the warp yarns while this for the weft yarns can be met mainly by high performance control of weft picking.

In this regard, the above-mentioned conventional weft picking control system disclosed in the United States Patent is so configurated as to make constant the timing at which the picked weft yarn reaches the anti-weft picking side, so that the tension of the picked weft yarn is not directly detected. Accordingly, if the reaching timing is controlled to be constant, the tension of the picked weft yarn unavoidably varies in case where a weft package is substitued by a new one in which the tension of the weft yarn wound in the weft package varies depending upon different weft packages Thus, it will be difficult to obtain high quality woven clothes by using such a conventional weft picking control system.

SUMMARY OF THE INVENTION

A loom of the present invention is equipped with a weft picking control system which consists of a device for detecting the force (tension) of a picked weft yarn at a time in the vicinity of termination of travel of the weft yarn in weft picking. The thus detected weft yarn force is compared with a standard force (tension) by a comparing device thereby to obtain a discrepancy therebetween. Then, the operation of the loom is controlled in accordance with the discrepancy between the actual weft force and the standard force.

Accordingly, for example in case of a fluid jet loom, fluid to be supplied to a weft inserting nozzle is controlled to maintain the force (tension) of the picked weft yarn to a constant value, thus facilitating to weave high quality cloths while removing the possibility of arising yarn cutting.

BRIEF DESCRIPTION OF THE DRAWINGS

The features and advantages of the loom of the present invention will be more clearly appreciated from the following description taken in conjunction with the accompanying drawings in which like reference numerals designate corresponding elements and parts, and in which.

DETAILED ESCRIPTION OF THE INVENTION

Figure 1:
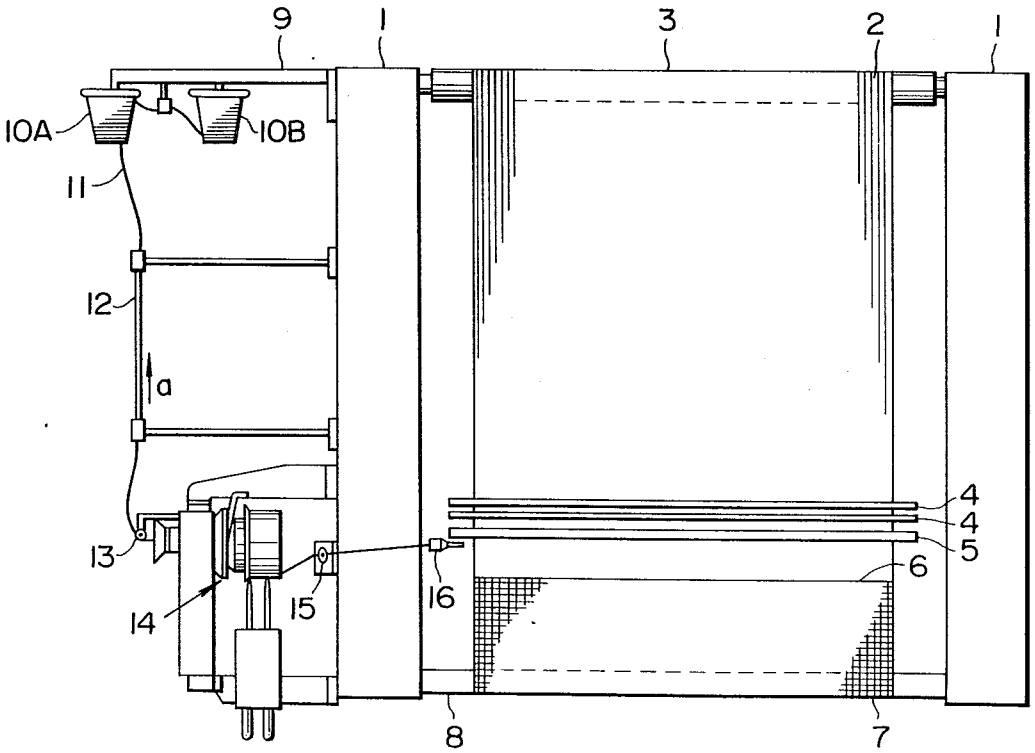
FIG. 1 is a plan view of a first embodiment of a loom of the present invention.

Referring now to FIG. 1, there is shown a first embodiment of a fluid jet loom of the present invention. The loom consists of frames 1, 1 on which a back roller 3 is rotatably supported. Warp yarns 2 are being passed on the back roller 3 and extend through healds 4 and a reed 5 to form a cloth fell 6 from which a woven cloth 7 extends through a breast beam 8 to a take-up motion (not shown). Weft packages 10A, 10B are supported by a package holder 9 which is fixed to the frame 1. A weft yarn 11 drawn off from the package 10A is being passed through an air tensor 12 in which air stream is produced in the direction of an arrow a, and then is introduced through a guide pulley 13 to a drum type weft storage or detaining device 14 as disclosed, for example, in U.S. Pat. No. 4,378,821 entitled "Weft Detaining Device of Shuttleless Loom". The weft yarn 11 introduced to the weft storage device 14 is wound thereon and thereafter passed through a weft brake or gripper 15 which is adapted to grip and release the weft yarn 11 at predetermined timings. The weft yarn 11 from the weft brake 15 is passed through a main or weft inserting nozzle 16 for weft insertion, which nozzle is arranged to swingably move with the reed 5 as a single member.

Figure 2:
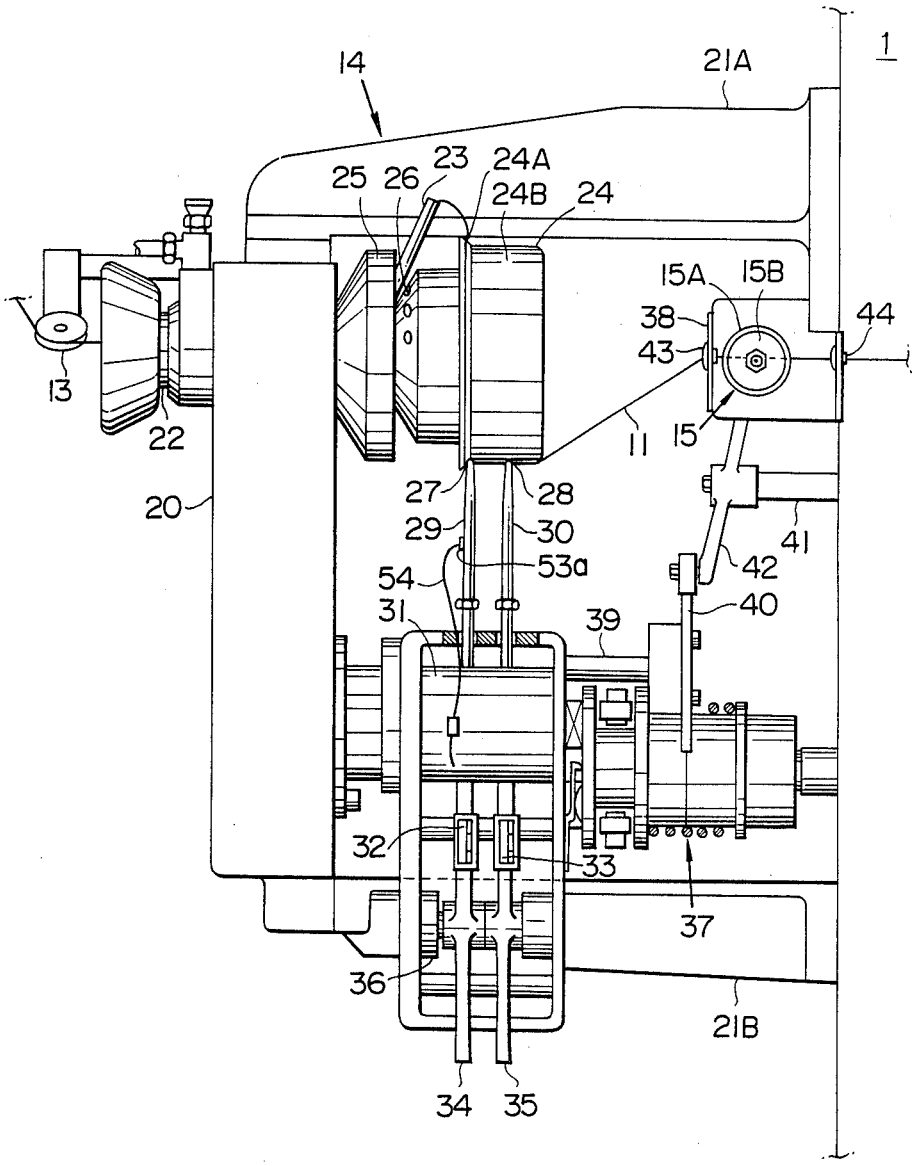
FIG. 2 is a plan view of a part of the loom of FIG. 1, mainly showing a weft storage device.
Figure 3:
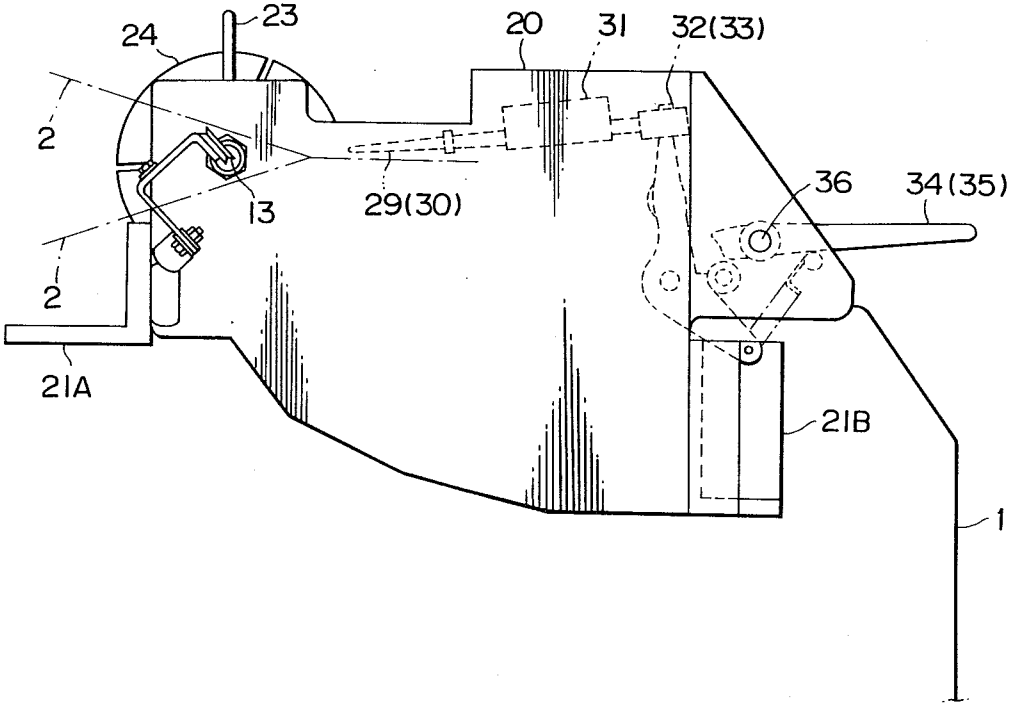
FIG. 3 is a side view of the loom part of FIG. 2, mainly showing the weft storage device.

As shown in FIGS. 2 and 3, a gear box 20 is fixed to stays 21A, 21B projected from the frame 1. A hollow rotatable shaft .22 is rotatably supported by the gear box 20. The roatable shaft 22 is provided with a guide pipe 23 which projects therefrom in the direction away from the axis thereof. A drum 24 is rotatably mounted on one end section of the rotatable shaft 22 in such a manner as to be rotatable relative to the rotatable shaft 22. A magnet holder 25 is secured to the gear box 20 and fixedly provided with magnets (not shown) which face to magnets 26 fixed on the back face of the drum 24, so that the drum 24 is maintained in the stationary state even upon rotation of the rotatable shaft 22. The drum 24 includes a frustoconical winding section 24A on which the weft yarn 11 introduced is wound, and a generally cylindrical detaining section 24B on which the weft yarn 11 moved from the winding section 24A is detained. The drum 24 is formed with a hole 27 located at a border section between the winding section 24A and the detaining section 24B, and a hole 28 located in the detaining section 24B. Engaging pins 29, 30 are so movably disposed relative to the holes 27, 28 that each of them projects into or withdraws from the hole 27, 28. The engaging pins 29, 30 are slidably fitted in a guide member 31 and respectively provided with rectangular sections (no numerals) to which swingable members 32, 33 respectively so fit as to be reciprocally vertically movable in FIG. 3. Levers 34, 35 are rotatably mounted on a spindle 36 and so function as to pull out the engaging pins 29, 30 from the respective holes 27, 28 when manually operated.

A power transmitting device system 37 is provided to transmit power from a main shaft (not shown) of the loom to the gear box 20. A weft brake 15 is fixed to a base 38 which is in turn fixedly connected to the frame 1, and consists of lower and upper grip members 15A, 15B between which the weft yarn 11 lies. The gripping and releasing action to the weft yarn 11 is carried out by contacting and separating the upper grip member 15B relative to the lower grip member 15A under the swingable movement of a lever 42 which is rotatably mounted on a fixed shaft 41. The swingable movement of the lever 42 is made by a cam 40 fixed to a shaft 39 projected from the gear box 20. The reference numerals 43, 44 designate weft guides respectively disposed forward and rearward of the weft brake 15.

With this arrangement, the rotatable shaft 22 rotates together with the guide pipe 23 in timed relation to the main shaft of the loom, so that the weft yarn 11 is wound on the winding section 24A of the drum 24 while the engaging pins 29, 30 project into and withdraw from the holes 27, 28 at the predetermined timings. More specifically, such an operation will be explained assuming the time point of the termination of weft picking as an initial point. First, when the weft picking terminates, the engaging pin 30 gets out of the hole 28 while the engaging pin 29 is projecting in the hole 27, so that the weft yarn 11 is so extended to the weft guide 43 as to take the shortest distance after engaging with the engaging pin 29. Subsequently, the engaging pin 29 projects into the hole 28, and thereafter the engaging pin 29 gets out of the hole 27. As a result, the weft yarn 11 wound on the drum winding section 24A moves onto the detaining section 24B and is then wound thereon predetermined times (for example, four times) corresponding to the length of the weft yarn required for each weft picking. Thereafter, the engaging pin 29 projects into the hole 27 thereby to separate the thus wound weft yarn 11 from the weft yarn which will be wound hereinafter. When the time period of weft picking has come, the weft brake 15 releases the weft yarn 11 and the engaging pin 30 gets out of the hole 28, thereby accomplishing the weft picking of the weft yarn 11 under the action of the air injection from the main nozzle 16. At this time, the weft yarn 11 wound on the detaining section 24B is wound off four times and brought into engagement with the engaging pin 29 thereby to complete or terminate the weft picking. Thereafter, the weft yarn 11 is gripped by the weft brake 15.

Figure 4:
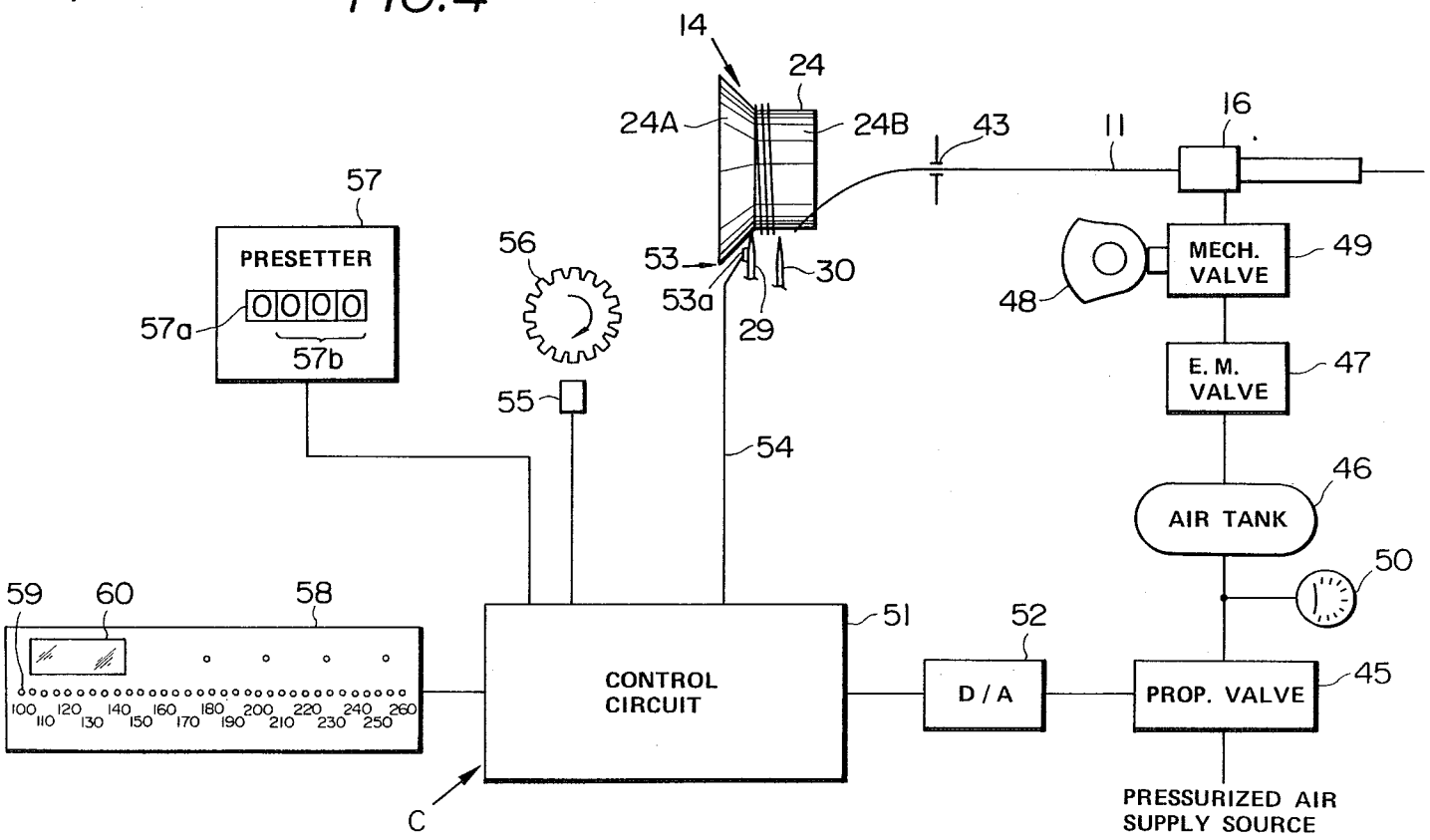
FIG. 4 is a schematic illustration of an essential part of the loom of FIG. 1, showing a control system for the loom.

The thus arranged loom is provided with a control system C for controlling air pressure to be supplied to the main nozzle 16 as shown in FIG. 4. Referring to FIG. 4, the main nozzle 16 is supplied with pressurized air from a pressurized air supply source through an electric signal-air pressure proportion valve 45, an air tank 46, an electromagnetic valve 47, and a mechanical valve 49. The electric signal-air pressure proportion valve 45 is adapted to function to regulate the pressure of air from the pressurized air supply source to a level in proportion to an electric signal input thereto. The air tank 46 is adapted to detain an amount of air required for about one weft picking. The electromagnetic valve 47 is so adapted as to be open upon closing of a stating preparation switch (not shown) of the loom while to be close upon stopping of the loom. The mechanical valve 49 is so adapted as to be open during a predetermined time period, for example, the weft picking time period of a weaving cycle of the loom. It will be understood that the valves 45, 47, 49 are so arranged that pressurized air from the pressurized air supply source can flow therethrough when they are open. Additionally, a pressure gauge 50 is disposed between the valve 45 and the air tank 46.

A control circuit 51 forming part of the control system C is adapted to output digital signals which are to be converted to analog signals by a D/A converter 52, the analog signals being input to the electric signal-air pressure proportion valve 45. Input to the control circuit 51 are signals from a weft tension detector 53, from an angle sensor 55, and from a presetter 57. Additionally, signals from a proximity switch (not shown) are also input to the control circuit 51, which switch is adapted to produce a signal per one rotation of the loom main shaft. The weft tension detector 53 is adapted to detect the tension of the weft yarn 11 when the flight or travel of the weft yarn 11 has terminated or been completed, and includes a strain gauge 53*a* (as a tension sensor element) bonded to the side wall of the engaging pin 29 .which strain gauge is electrically connected through a lead wire 54 to the control circuit 51. The strain gauge 53*a* is adapted and located to sense the deflection of the engaging pin 29 when the picked weft yarn 11 is brought into engagement with the engaging pin 29. The weft tension detector 53 may include a tension sensor element of the piezoelectric type in place of the strain gauge. The angle sensor 55 is located facing to a rotatable member 56 which rotates in timed relation to the loom main shaft and provided at its periphery with three hundreds and sixty projections. The angle sensor 55 is adapted to sense each projection of the rotatable member 56 and detect the rotation angle of the loom main shaft (referred hereinafter to "main shaft angle"), in which count-up of 1° is made upon sensing of each projection of the rotatable member 56 and in which the output corresponding to 0° is made subsequently to the output corresponding to 359°. The presetter 57 is adapted to preset the informations required for the control circuit 51, and includes a binary switch 57*a* by which hexadecimal input is possible to be made, and three decimal switches 57*b* and the like. The binary switch 57*a* is used to select a programming mode.

A timing displaying device 58 is adapted to display the main shaft angle when the tension of the weft yarn 11 at the time of its flight termination has been detected. The timing displaying device 58 includes a predetermined number of light emitting diodes 59 which are located in a row along an angular scale formed on the device 58, in which the light emitting diode 59 corresponding to the main shaft angle emits light under the action of the signal from the control circuit 51. In this case, the light emitting diodes 59 are located at intervals of 5°, so that the light emitting diode 59 in the angular position near the measured value emits light. The displaying device 58 is also provided with a display section 60 for displaying air pressure supplied to the main nozzle 16 or digital output corresponding to the digital signal supplied to the D/A converter 52. Accordingly, the control circuit 51 accomplishes predetermined operations in accordance with the control inputs from the weft tension detector 53, the angle sensor 55, and the presetter 57, so that outputting is made to the D/A converter 52 and the displaying device 58 thereby to carry out controlling air pressure to be supplied to the main nozzle 16 and displaying a predetermined matter.

Figure 5:
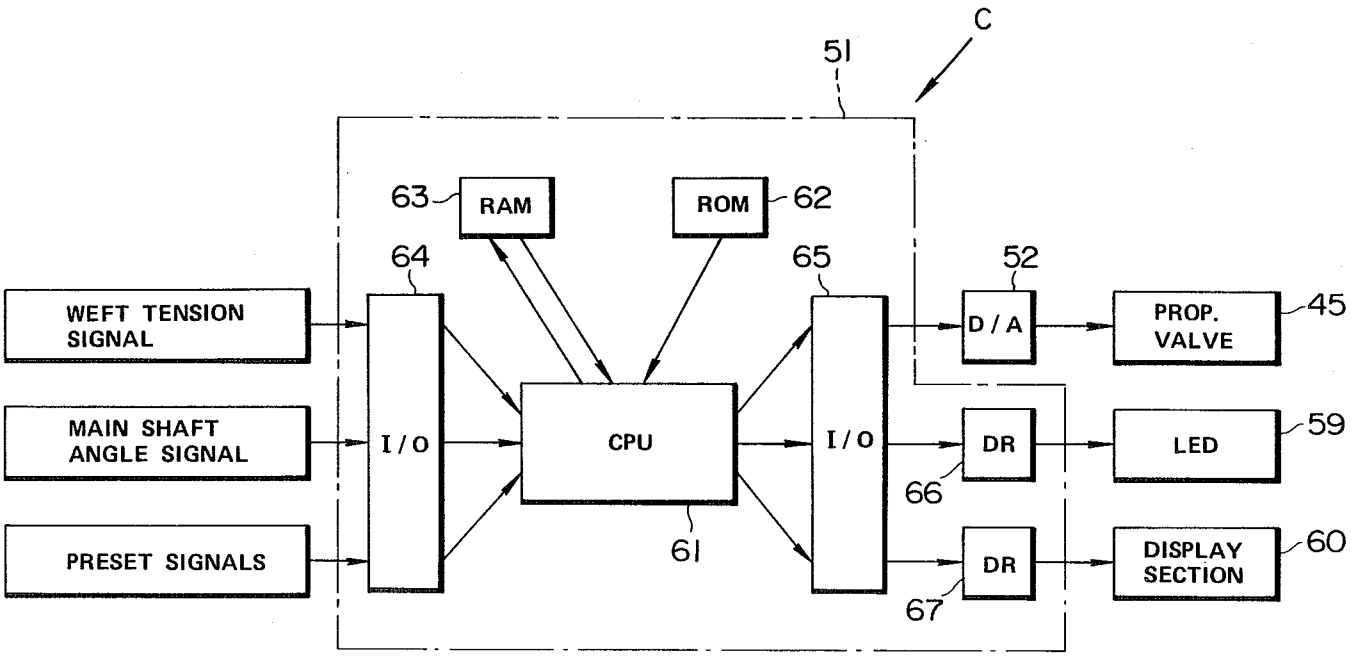
FIG. 5 is a block diagram of a hardware arrangement of a control circuit forming part of the control system of FIG. 4.

As shown in FIG. 5, the control circuit 51 includes a CPU 61, a ROM 62, a RAM 63, I/O (input and output) devices 64, 65, and drivers 66, 67. Accordingly, read through the I/O device 64 in the CPU 61 are a signal (representative of a tension value T of the weft yarn 11) from the weft tension detector 53, a signal (representative of the main shaft angle) from the angle sensor 55, and a signal (representative of a standard tension set value To of the weft yarn), a signal (representative of an allowable limit set value LM), a signal (representative of a pressure upper limit set value Va of air, to be supplied to the main nozzle 16), a signal (representative of a pressure lower limit set value Vb of air to be supplied to the main nozzle 16), and a signal (representative of an initial pressure set value V of air to be supplied to the main nozzle 16) from the presetter 57. Necessary data are written in the RAM 63 and read out from the RAM 63 in accordance with the program of the ROM 62, and output to the D/A converter 52 through the I/O device 65. Additionally, the outputting is made through the I/O device 65 to the light emitting diodes 59 for timing display and to the display section 60 for air pressure digital display.

The manner of operation of the loom provided with the control system C will be discussed hereinafter with reference to FIGS. 6 and 7.

Figure 6:
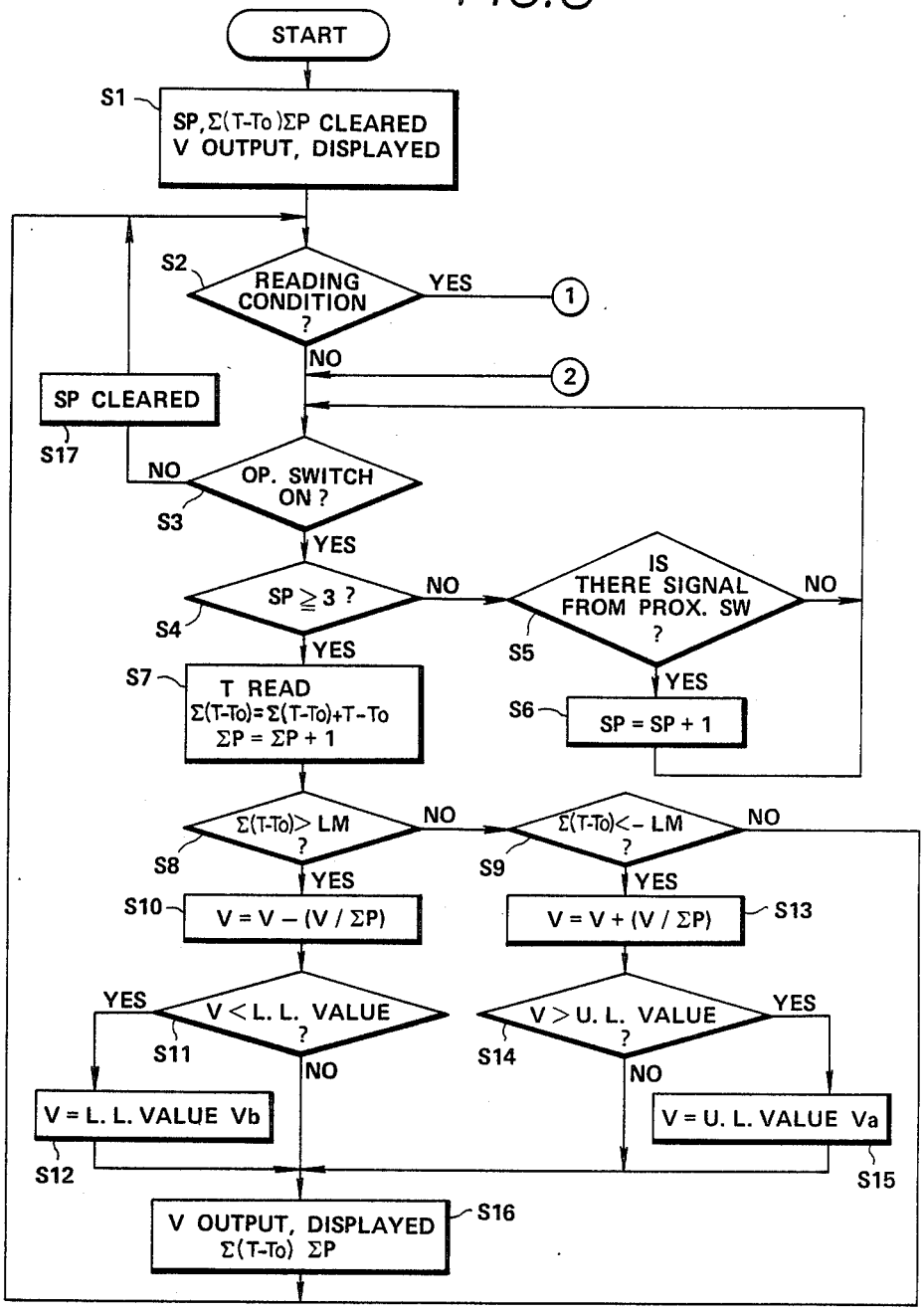
FIGS. 6, 7A and 7B are flow charts showing the procedure of the control of the control system of FIG. 4.
Figure 7A:
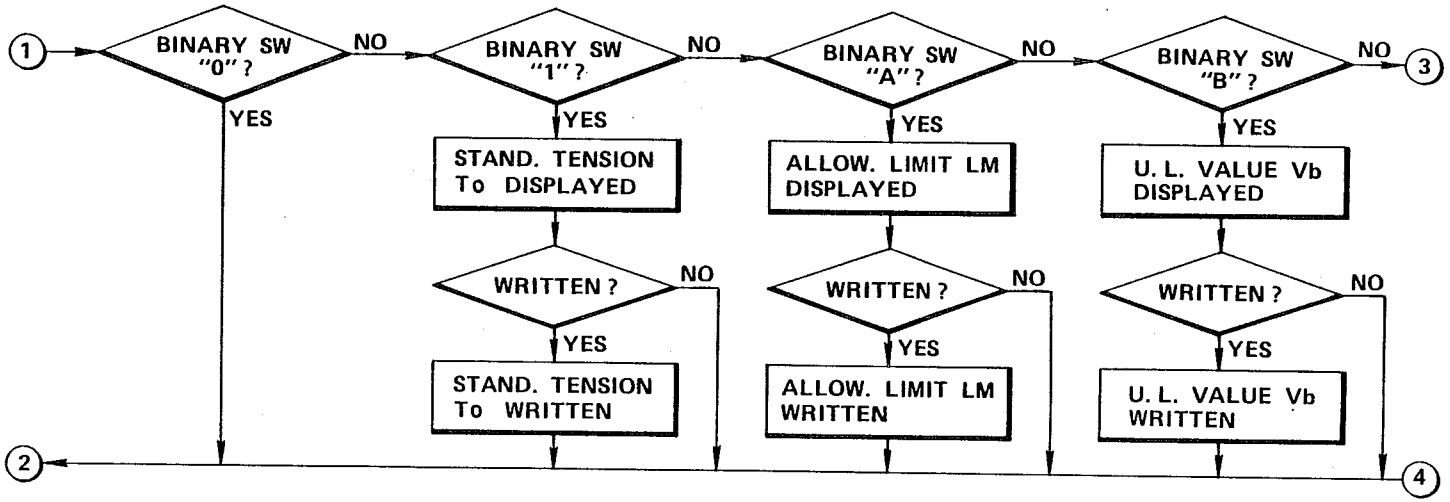
Figure 7B:
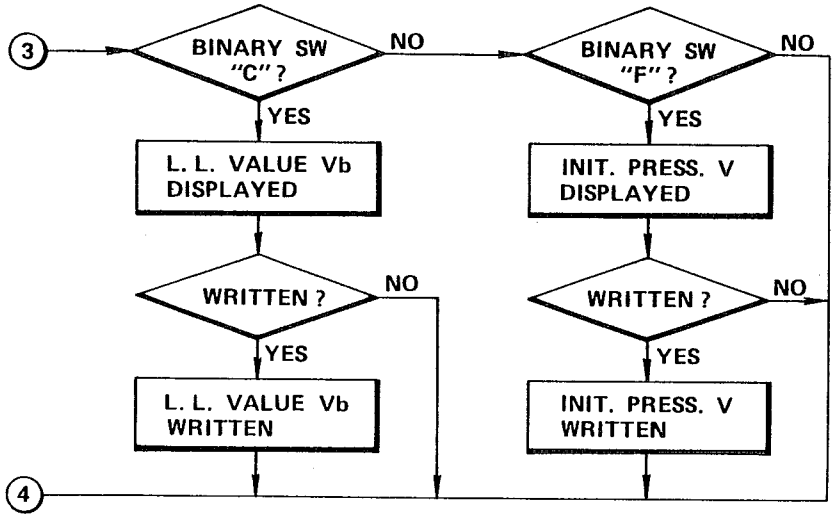

First, when the loom is electrically connected to an electric source, the pick number SP from the starting of loom operation and accumulated values $\Sigma(T-To)$, $\Sigma P$ discussed after are cleared, and a previously set voltage value corresponding to the output of the D/A converter 52 is displayed in the display section 60 for air pressure digital display (See a step S1 of a flow chart in FIG. 6). Here, the voltage value is set corresponding to the value of air pressure to be supplied to the main nozzle 16.

Subsequently, a discrimination is made as to whether a reading condition (in which reading is made) of the informations from the presetter 57 (a reading switch by which reading operation is carried out: ON) has been reached or not (See a step S2). In case where various conditions are newly set or changed in the reading condition, such conditions are input through the presetter 57 in accordance with the flow chart in FIG. 7. More specifically, in case where the binary switch, 57*a* of the presetter 57 is "0", the procedure immediately comes back to the flow chart in FIG. 6 thereby to make a discrimination as to whether a loom operation switch by which the loom is operated has been switched ON (See a step S3). However, in case where the binary switch 57*a* is "1" in which the standard tension value To of the weft yarn 11 is to be set, a discrimination is made as to whether a new one of the standard tension value To is to be written (the writing switch : ON) after the presently set value is displayed. When written, the value set by the three decimal switches 57*b* is written in the RAM 63 to be memorized. That is to say, in order to set the standard tension value To, it is sufficient that the binary switch 57*a* is set to be "1"; the standard tension is set, for example, at 50*g* by the decimal switches 57*b;* and the writing switch is switched ON.

In order to set the allowable limit value LM, it is sufficient that the binary switch 57*a* is set to be "A"; the decimal switches 57*b* are set, for example, at 10; and the writting switch is switched ON. In order to set the pressure upper limit value Va, it is sufficient that the binary switch 57*a* is set to be "B"; the value Va is set by the decimal switches 57*b* and the writting switch is switched ON. In order to set the pressure lower limit value Vb, it is sufficient that the binary switch 57*a* is set to be "C" and then a similar procedure to the case of setting the pressure upper limit value Va is carried out. In addition, in order to set the initial pressure value V, it is sufficient that the binary switch 57*a* is set to be "F"; the value V of the pressure is set by the decimal switches 57*b;* and the writting switch is switched ON.

Subsequently, when the operation switch of the loom is switched ON, the pick number SP from the loom operation starting is judged (See a step S4). Until the pick number SP has reached two, a discrimination is made as to whether there is a signal from the proximity switch or not (See a step S5). In case where there is the signal, the pick number SP is counted up (See a step S6), standing ready to become three. Thus, until the pick number SP has reached two, the pressure control and reading the informations therefor are not carried out, merely standing ready for the stable revolution of the loom.

After the pick number SP has reached three, the weft tension value T is read through the signal from the weft tension detector 53 when the weft yarn 11 is brought into engagement with the engaging pin 29 at the time weft flight or travel terminates. Then, a subtraction of the standard tension value To from the weft tension value T is carried out to obtain the difference (T−To) therebetween, and the accumulating value Σ(T−To) of a plurality of such differences is calculated. Simultaneously, the value of the ΣP indicating the number of picks from the starting of such an accumulation is increased by one (See a step S7).

Next, a discrimination is made as to whether the accumulated value Σ(T−To) of the differences (T−To) exceeds the allowable limit LM (for example, ±10) on the plus or minus sides or not (See Steps S8 and S9). In case of exceeding the plus side allowable limit LM, the present pressure value (or the previously set initial pressure value) V is divided by the pick number ΣP (for example, 10) which was obtained before exceeding the allowable limit LM. The thus obtained divided value is subtracted from the present pressure value V thereby to set a new pressure value V (See a step S10). Subsequently, the thus set pressure value V is compared with the lower limit value Vb (See a step 11), and set as a lower limit value Vb in case of being smaller than the lower limit value Vb (See a step S12). In case of exceeding the minus side allowable limit LM, the present pressure value V is divided by the pick number P before exceeding the allowable limit LM. The thus obtained divided value is added to the present pressure value V thereby to set a new pressure V (See a step S13). Subsequently, the thus set the pressure V is compared with the upper limit value Va (See a step S14), and set as an upper limit value Va in case of being larger than the upper limit value Va (See a step S15). The thus newly set pressure V is output to the D/A converter 52, and also displayed in the display section 60. Simultaneously, Σ(T−To) and ΣP are cleared (See a step S16). As discussed above, the pressure value V is set either equal to the lower limit value Vb or the upper limit value Va in order to prevent it from becoming an abnormal value, for example, by an error in calculation being made in the control system. It is to be noted that the lower limit value Vb is a value below which mispicks tend to occur, whereas the upper limit value is a value above which weft yarn cutting tends to occur.

Thus, in case where the accumulated value of the differences between the detected value and the standard value of the weft tension exceeds the plus side allowable limit, the weft tension is too large and therefore the pressure V to be supplied to the main nozzle 16 is lowered by an amount corresponding to the pick number required before exceeding the allowable limit, thereby weakening the traction force of air ejected from the main nozzle 16. This decreases the weft tension at the time of the flight termination of the weft yarn, thus maintaining the weft tension at a constant value. On the contraty, in case where the accumulated value exceeds the minus side allowable limit, the weft tension is too small and therefore the pressure V to be supplied to the main nozzle 16 is raised by an amount corresponding to the pick number required before exceeding the allowable limit, thereby enlarging the traction force of air ejected from the main nozzle 16. This increases the weft tension at the time of the flight termination of the weft yarn, thus maintaining the weft tension at a constant value. It will be understood that supply of the previous pressure V to the main nozzle 16 is continued in case where the accumulated value of the differences between the detected value and the standard value of the weft tension does not exceed the allowable limits. Additionally, in case where the operation switch is switched OFF, the pick number SP from the loom operation starting is cleared (See a step S17), and then standing ready is made.

Here, when the weft package 10A becomes into its empty state from its fully wound state, the pressure value V tends to gradually lower in connection with the drawing resistance of the weft yarn 11, so that the pressure value V becomes smaller than the lower limit value Vb before the weft package 10A has become into the empty state. In this case, the pressure V remains holded at the lower limit value Vb. This operation is programmed by the following reasons: even when the fully wound state has been reached upon being changed to another weft package 10B, the pressure V in the empty wound state is maintained until the accumulated value Σ(T−To) exceeds the allowable limit; therefore, if the pressure V is too lowered in the empty wound state, the pressure V becomes too low when changed into the fully wound state, thereby giving rise to failed weft picking. In this regard, it is necessary to set the lower limit value Vb within a range where mispick and weaving defect of woven cloth do not arise. Additionally, it is necessary to set the upper limit value Va within a range where weft cutting and air loss do not arise. Furthermore, the operation of the control system C is so programmed that the main shaft angle signal is read at the time of production of the weft tension signal from the weft tension detector 53, causing the light emitting diode 59 corresponding to the main shaft angle to emit light, thus visualizing the timing of the production of the weft tension signal.

Figure 8:
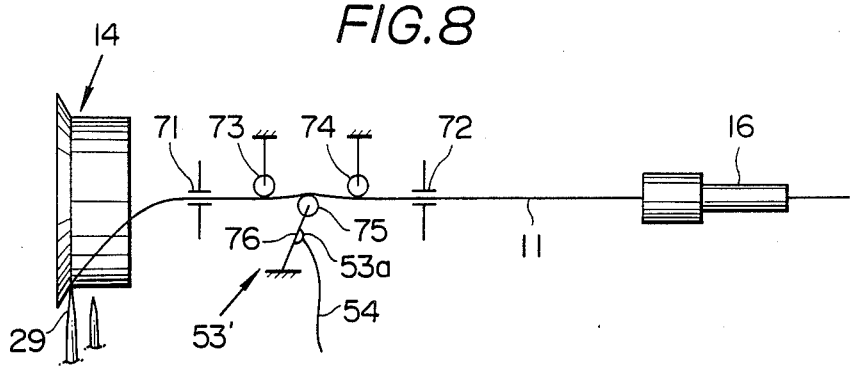
FIG. 8 is a schematic illustration of an essential part of a second embodiment of a loom of the present invention.

FIG. 8 illustrates a second embodiment of the loom of the present invention including another example of the weft tension detector 53'. In this embodiment, the weft tension detector 53' consists of stationarily two rollers 73, 74 which are disposed to the weft passage between two separately disposed weft guides 71, 72 located between the weft storage device 14 and the main nozzle 16. A roller 75 is located between the two rollers 73, 74 and generally on the opposite side of the two rollers 73, 74 with respect to the weft passage. The roller 75 is rotatably attached to an elongated support member 76 which is inclined relative to the weft passage. The strain gauge 53*a* as a weft tension sensor element is bonded on the surface of the support member 76 and electrically connected to the control circuit 51 shown in FIG. 4.

With this arrangement, when the weft yarn 11 is brought into engagement with the engaging pin 29, the tension of the weft yarn 11 abruptly increases, so that the support member 76 is subjected to deflection which is sensed by strain gauge 53*a*. It will be understood that the weft yarn 11 is always bent under the action of the roller 75 in this arrangement, and therefore the movement resistance of the weft yarn 11 unavoidably becomes relatively high. Accordingly, this arrangement appears suitable for a water jet loom as compared with for an air jet loom.

Figure 9:
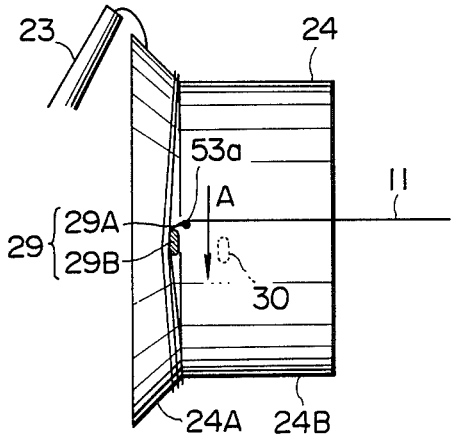
FIG. 9 is a side view of a weft storage device drum showing an example of a weft tension detector usable in place of a weft tension detector of the loom of FIG. 1.
Figure 10:
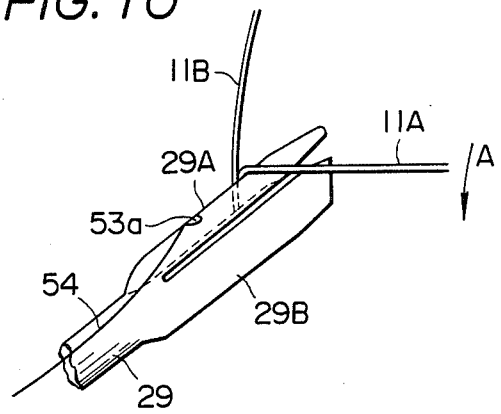
FIG. 10 is a perspective view of an essential part of the weft tension detector of FIG. 9.
Figure 11:
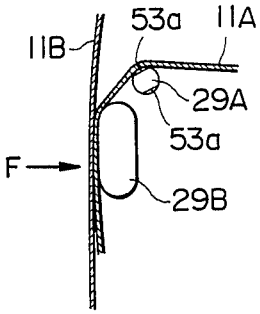
FIG. 11 is an enlarged view of an essential part of FIG. 9.

FIGS. 9, 10 and 11 show a further example of the weft tension detector 53" usable in the loom of the present invention. In this example, the engaging pin 29 is bifurcated to form first and second pin sections 29A, 29B as clearly shown in FIG. 10. The first pin section 29A is located upstream of the second pin section 29B in a direction (indicated by an arrow A in FIG. 9) in which the weft yarn 11 is wound off on the detaining section 24B at the time of weft picking. Additionally, the first pin section 29A is located shifted on the weft picking side or rightward in FIG. 9 relative to the second pin section 29B. The strain gauge 53*a*, as a weft tension sensor element, is bonded onto the surface of the first pin section 29A. The strain gauge 53*a* is electrically connected through the lead wire 54 to the control circuit 51.

With this arrangement, as clearly shown in FIG. 11, a portion 11B of the weft yarn wound on the tapered winding section 24A of the weft storage drum 24 is engaged to the second pin section 29B, so that a lateral force F of the weft yarn portion 11B does not act on the first pin section 29B. The weft yarn portion 11B stands ready to be picked subsequently to the already picked weft yarn portion 11B. It will be understood that the weft yarn portion 11B is mainly engaged with the first pin section 29A when the weft picking terminates as illustrated by the weft yarn portion 11B of FIG. 11. Consequently, the above-mentioned lateral force F of the weft yarn portion 11B acts only on the second pin section 29B of the engagement pin 29 but never acts on the first pin section 29A, so that the tension of the weft yarn portion 11A effectively acts on the first pin section 29A provided with the strain gauge 53*a*. As a result, the tension of the picked weft yarn portion 11B can be effectively detected without being subjected to the lateral force F of the weft yarn portion 11B, even in case where fine and weak yarn (such as one of 40 denier) is used as the weft yarn 11. In this example, the strain gauge 53*a* is preferably located at a first position lying on the longitudinal extension of a position to which the weft yarn 11 contacts, or otherwise at a second position on the opposite side of the first position as seen from FIGS. 10 and 11.

While only the bifurcated engaging pin 29 has been shown with reference to FIGS. 9 to 11, it will be understood that the first and second pin sections 29A, 29B may be formed completely separate and independent from each other and driven separately from each other. In addition, it will be appreciated that this arrangement of FIGS. 9 to 11 is usable in various control systems other than for controlling the air pressure to be supplied to the main nozzle, and of course usable to a case where only detection of weft tension is carried out. Additionally, this weft tension detector of FIGS. 9 to 11 is usable in a gripper shuttle type loom. Although only the cylindrical drum of weft storage device 24 has been shown and described, the drum may not be cylindrical in which it s formed by generally cylindrically arranging a plurality of rollers.

Figure 12:
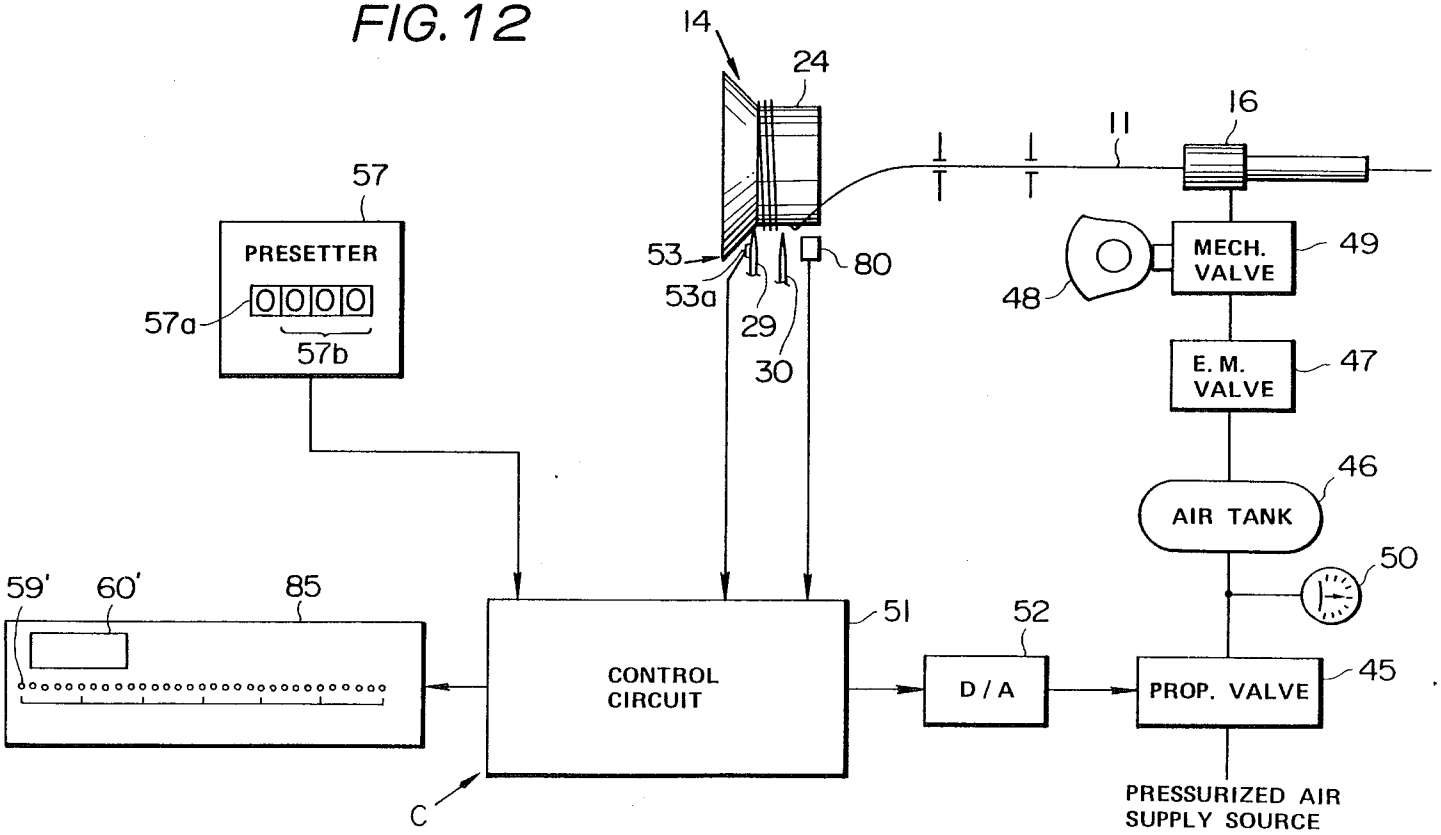
FIG. 12 is a schematic illustration similar to FIG. 4 but showing a third embodiment of the loom of the present invention including a control system for the loom.

FIGS. 12 to 18 illustrate a third embodiment of the loom of the present invention which is similar to the embodiment of FIGS. 1 to 5 with the exception that a weft wind-off detector 80 is used in place of the angle sensor 55. The wind-off detector 80 is adapted to detect the passage of the weft yarn 11 wound off from the drum 24 at the time of weft picking. In this embodiment, the signal from the weft tension detector 53, the signal from the presetter 57, and signal from the wind-off detector 80 are input to the control circuit 51 as shown in FIG. 12. Additionally, a signal from a proximity switch (not shown) is also input to the control circuit 51, which switch is adapted to produce a signal per one rotation of the loom main shaft.

Figure 13:
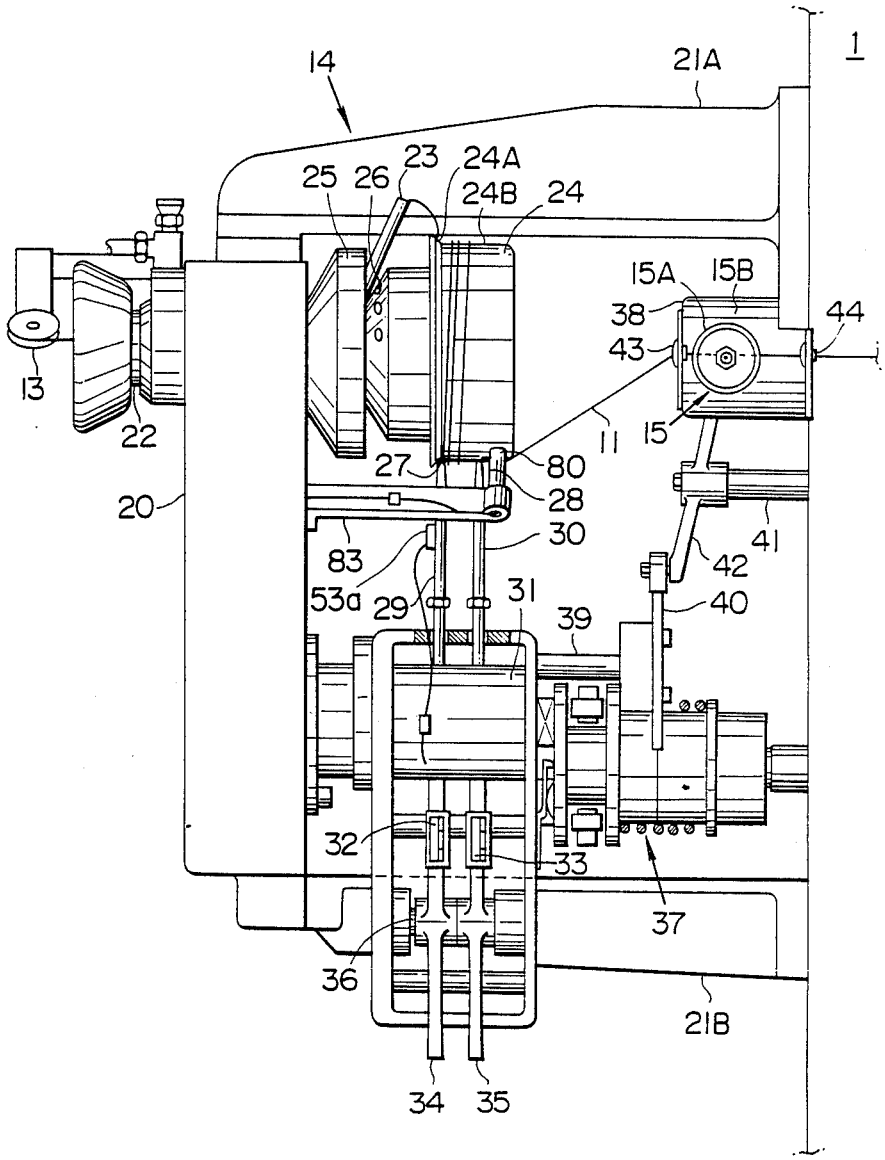
FIG. 13 is a plan view similar to FIG. 2, but showing a part of the loom of FIG. 12.
Figure 14:
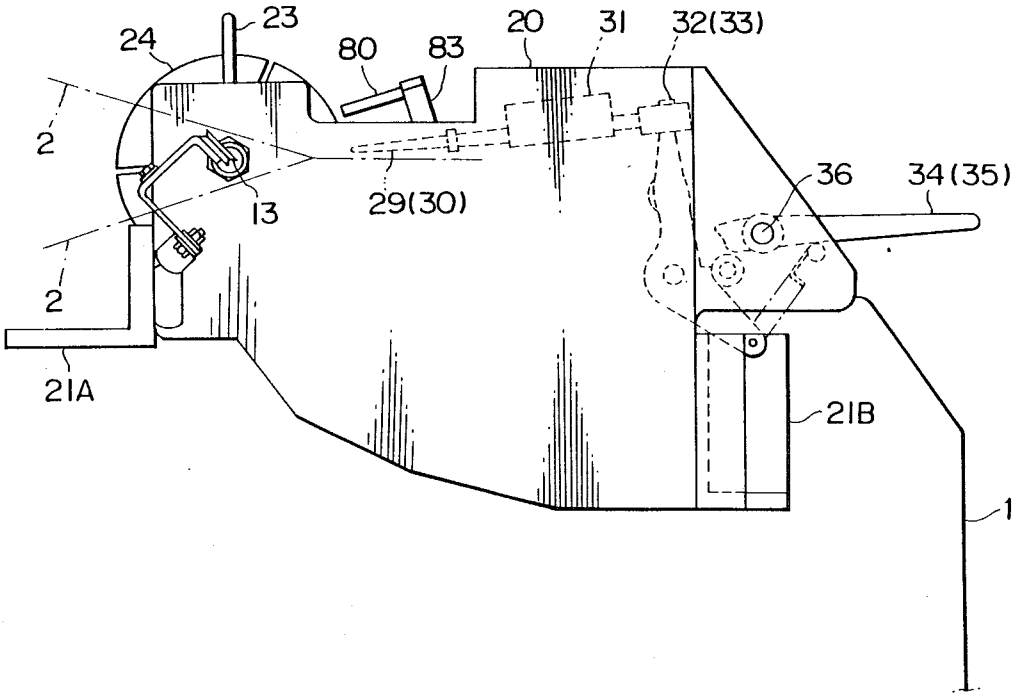
FIG. 14 is a side view of the loom part of FIG. 13.
Figure 15:
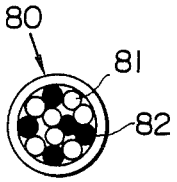
FIG. 15 is an enlarged view of the tip end of a weft wind-off detector used in the loom of FIG. 12.
Figure 16:
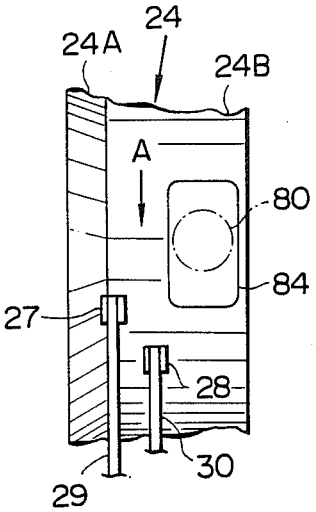
FIG. 16 is a fragmentary front view of a weft storage device drum in connection with the weft wind-off detector of FIG. 15.
Figure 17:
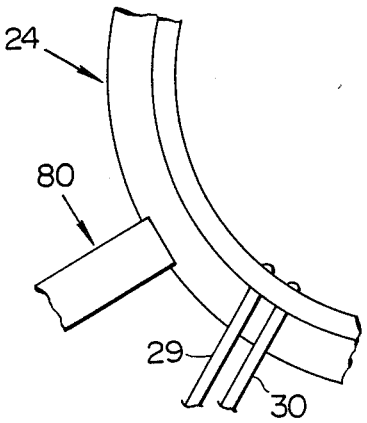
FIG. 17 is a fragmentary side view of the drum of FIG. 16 in connection with the weft wind-off detector.
Figure 18:
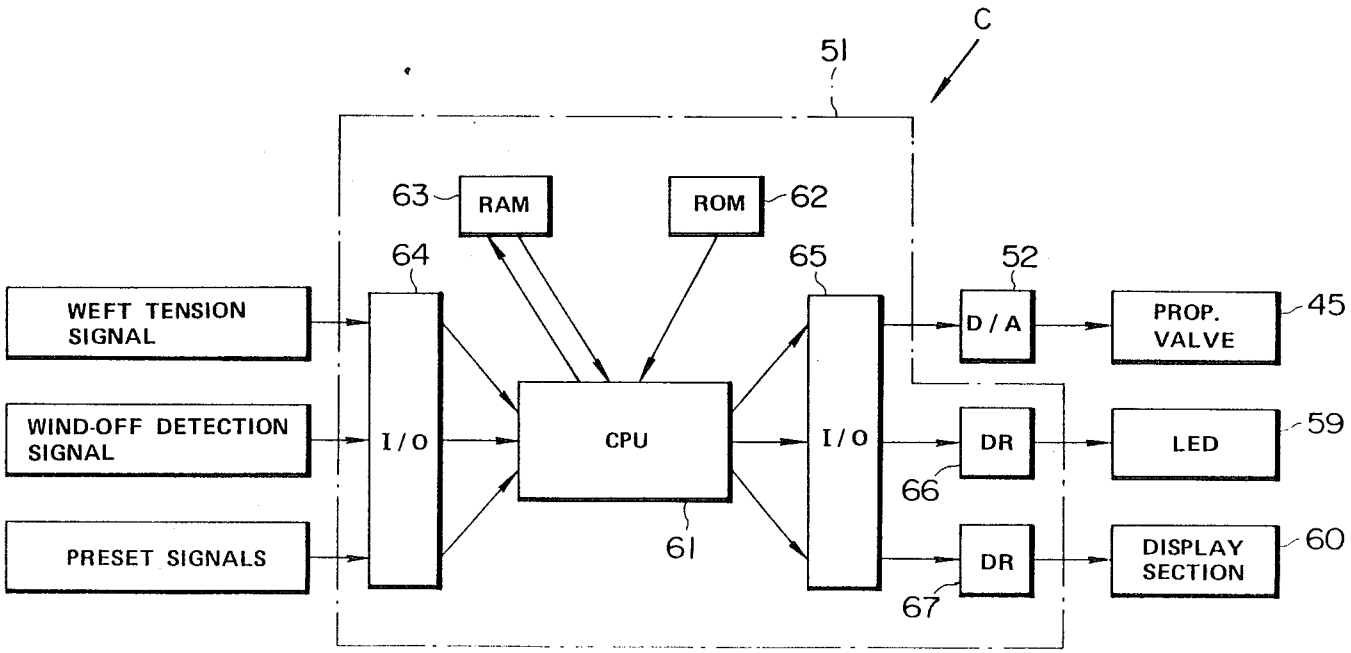
FIG. 18 is a block diagram of a hardware arrangement of a control circuit forming part of the control system of FIG. 12.

As shown in FIGS. 13 to 17, the wind-off detector 80 includes a bundle of optical fibers some of which have a light casting face 81 from which light is casted and the other having a light receiving face 82 through which light enters the optical fiber as shown in FIG. 15. As shown in FIGS. 16 and 17, the wind-off detector 80 is so disposed that the light casting and receiving faces 81, 82 spacedly face to a rectangular section 84 on the surface of the detaining section 24B of the weft storage drum 24, the rectangular section 84 being located on the side of the main nozzle 16 relative to the hole 28 and immediately on the upstream side of the holes 27, 28 in a direction (indicated by the arrow A) in which the weft yarn 11 is wound off. It will be understood that the engaging pins 29, 30 are insertable into the holes 27, 30, respectively. The wind-off detector 80 is securely supported to a bracket 83 fixed to the gear box 20 as shown in FIGS. 13 and 14. In this embodiment, the drum 24 is made of aluminum and covered with ceramic coating formed by flame spraying, in which the above-mentioned rectangular section 84 is formed by removing the ceramic coating thereby to expose the face of aluminum, the exposed aluminum face being then buffing to obtain a mirror face. The ceramic coating is for the purpose of preventing the slippage of the weft yarn 11 on the surface of the drum 24.

Thus, light casted from the light casting face 81 of the optical fiber is reflected on the mirror face of the rectangular section 84 and enters through the light receiving face 82 to the optical fiber. However, when the weft yarn 11 asses through between the mirror face of the rectangular section 84 and the light casting and receiving faces 81, 82 upon the weft yarn 11 being wound off from the drum weft detaining section 24B, light is interrupted to reduce the amount of light entering the optical fiber, thereby detecting the passage of the weft yarn 11. Here, assuming that the weft yarn 11 is being wound four times on the drum 24 as an amount corresponding to one weft picking, a detection signal is obtained per one time wind-off of the weft yarn 11 wound on the drum 24, so that four detection signals are obtained until the weft picking terminates. It is to be noted that the fourth detection signal of the four detection signals is used as a wind-off signal to be input through the I/O device 64 to the control circuit 51.

A tension displaying device 85 is adapted to display the tension of the weft yarn 11 when the flight or travel of the weft yarn 11 has terminated or been completed. The tension displaying device 85 includes a predetermined number of light emitting diodes 59' which are located in a row along an tension scale formed on the device 85, in which the light emitting diode 59' corresponding to the weft tension emits light under the action of the signal from the control circuit 51. In this case, the light emitting diodes 59' are located at intervals along the tension scale of 0.1 g, so that the light emitting diode 59' in the tensile position near the measured value emits light. The displaying device 85 is also provided with a display section 60' for displaying air pressure to be supplied to the main nozzle 16 or digital output corresponding to the digital signal supplied to the D/A converter 52. Accordingly, the control circuit 51 accomplishes predetermined operations in accordance with the control inputs from the weft detector 53, the wind-off detector 80, and the presetter 57, so that outputting is made to the D/A converter 52 and the displaying device 58 thereby to carry out controlling air pressure to be supplied to the main nozzle 16 and displaying a predetermined matter. Accordingly, read through the I/O device 64 in the CPU 61 are the signal (representative of a tension value T of the weft yarn 11) from the weft tension detector 53, and the wind-off signal (representative of detection of the wind-off operation of the weft yarn 11 from the drum 24) from the wind-off detector 80, and the signal (representative of a standard tension set value To of the weft yarn), the signal (representative of an allowable limit set value LM), the signal (representative of a pressure upper limit set value Va of air to be supplied to the main nozzle 16), the signal (representative of a pressure lower limit set value Vb of air to be supplied to the main nozzle 16), and the signal (representative of an initial pressure set value V of air to be supplied to the main nozzle 16) from the presetter 57. Necessary data are written in the RAM 63 and read out from the RAM 63 in accordance with the program of the ROM 62, and output to the D/A converter 52 through the I/O device 65. Additionally, the outputting is made through the I/O device 65 to the light emitting diodes 59 for weft tension display and to the display section 60 for air pressure digital display.

The operation of the loom of FIGS. 12 to 18 will be discussed hereinafter with reference to FIGS. 19A, 19B, 20A, 20B and 21.

Figure 19A:
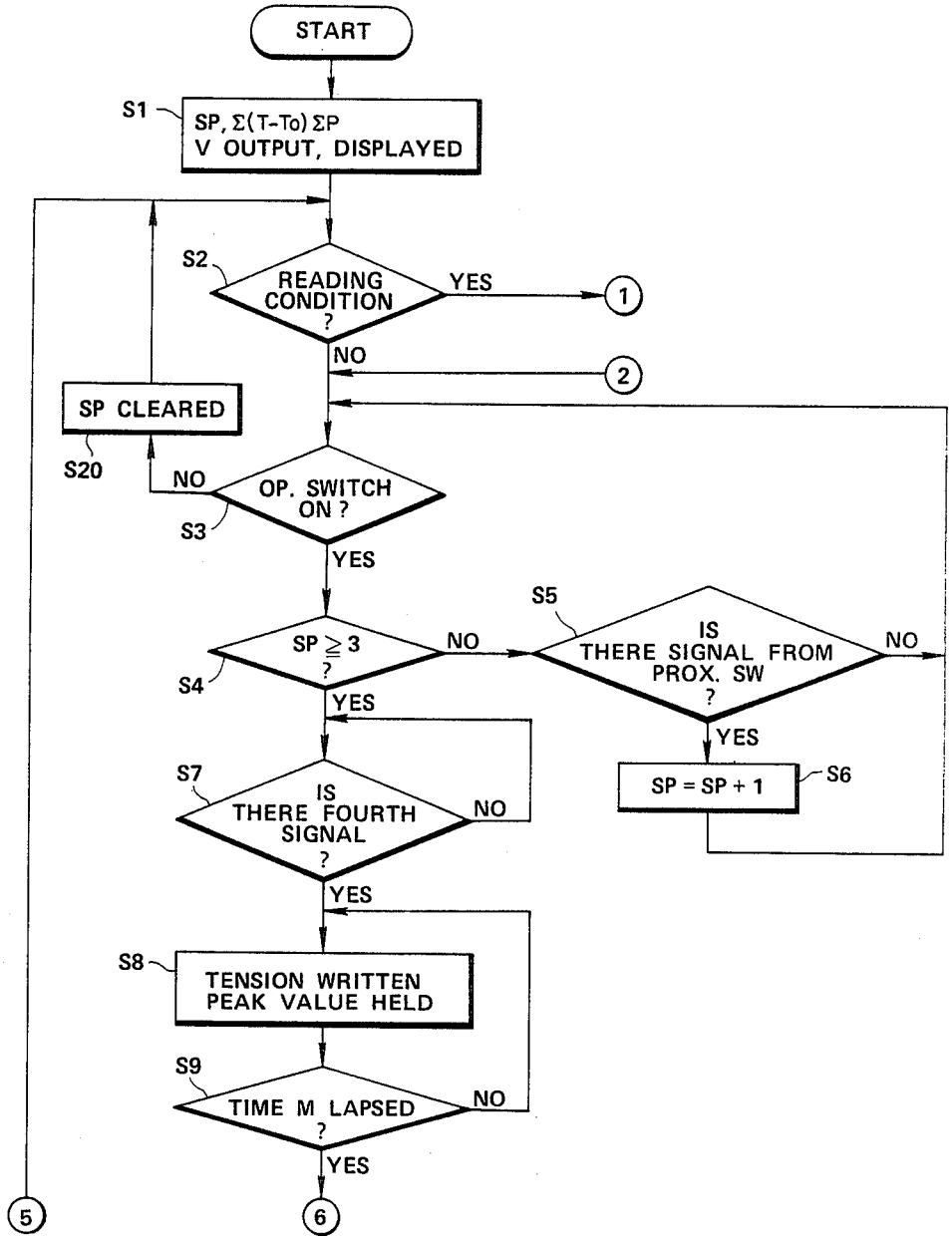
FIGS. 19A, 19B, 20A and 20B are flow charts showing the procedure of the control of the control system of FIG. 12.
Figure 19B:
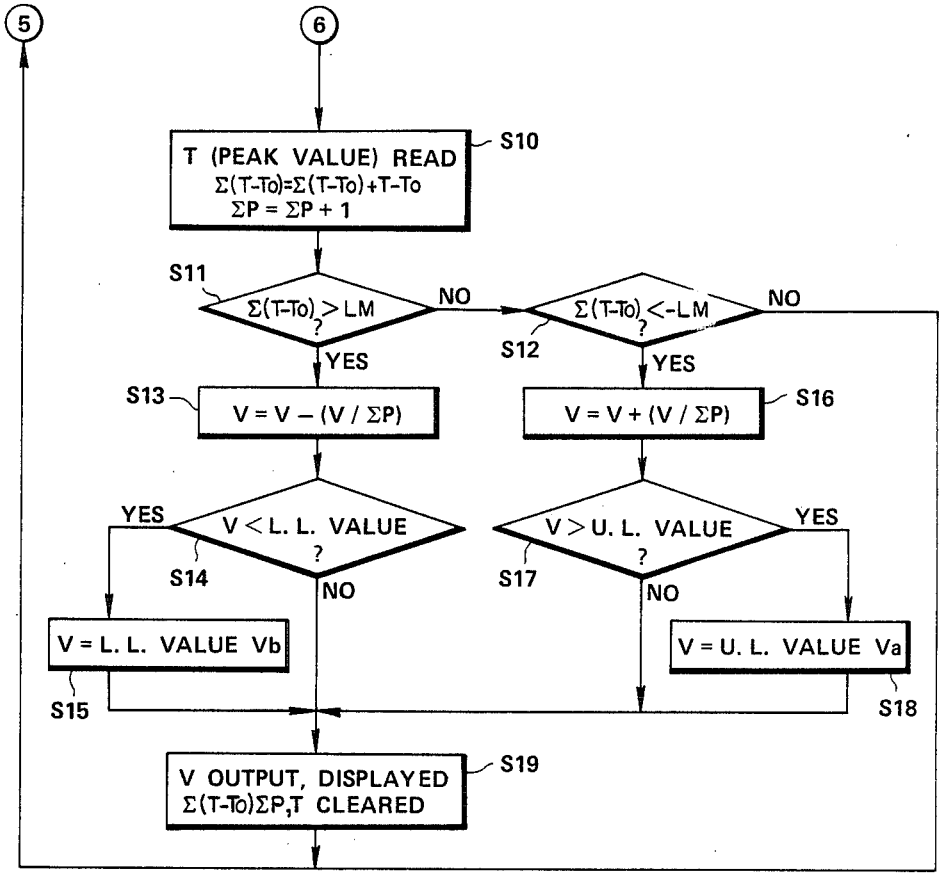
Figure 20A:
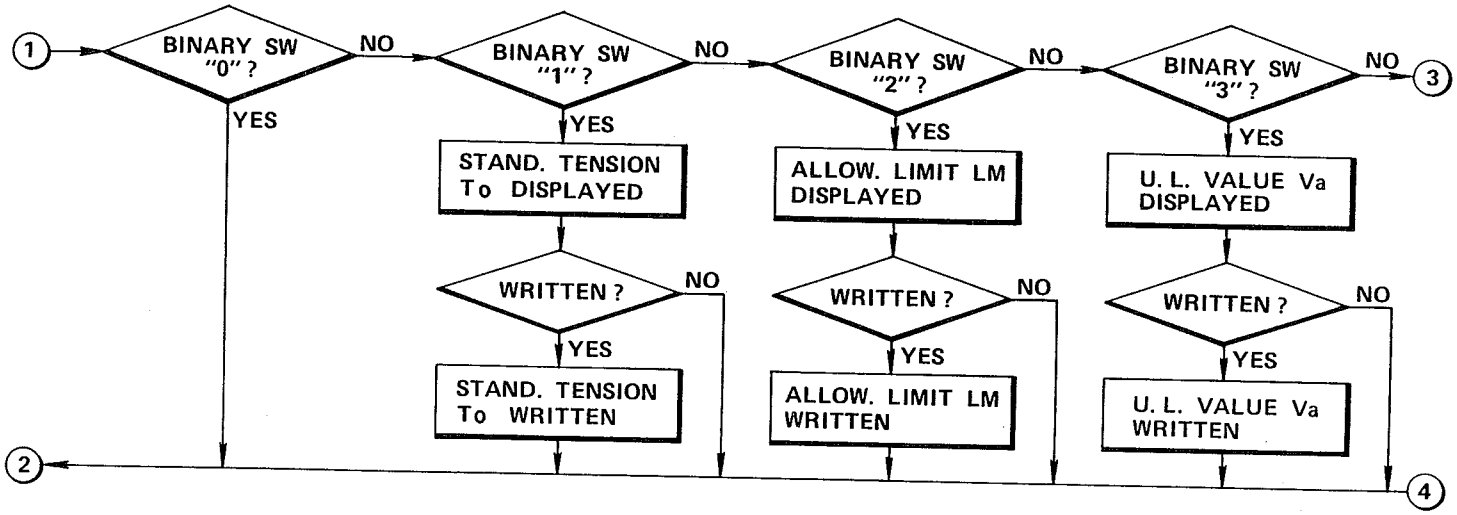
Figure 20B:
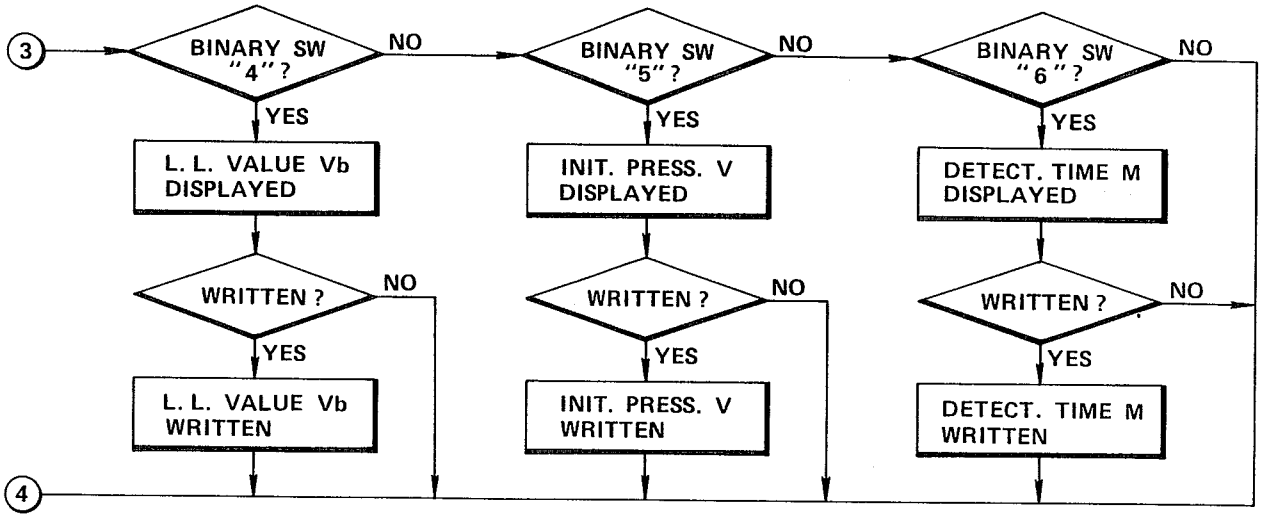
Figure 21:
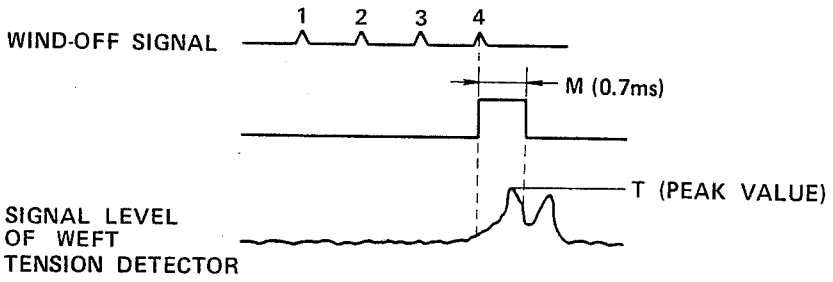
FIG. 21 is a graphical representation showing the relationship between a wind-off signal and the level of a signal from a weft tension detector in connection with the loom of FIG. 12.

When the loom is first electrically connected to an electric source, the pick number SP from the starting, of loom operation and the accumulated values $\Sigma(T-To)$, $\Sigma P$ are cleared, and the previously set voltage value corresponding to the output of the D/A converter 52 is displayed in the display section 60 for air pressure digital display (See a step S1 of a flow chart in FIG. 19A). Here, the voltage value is set to correspond to the value of air pressure to be supplied to the main nozzle 16. Subsequently, a discrimination is made as to whether a reading condition of the informations from the presetter 57 (the reading switch by which reading operation is carried out: ON) has been reached or not (See a step S2). In case where various conditions are newly set or changed in the reading condition, such conditions are input through the presetter 57 in accordance with the flow chart in FIGS. 20A and 20B. More specifically, in case where the binary switch **57*a* of the presetter 57 is "0", the procedure immediately comes back to the flow chart in FIGS. 19A, 19B thereby to make a discrimination as to whether the operation switch of the loom has been switched ON (See a step S3). However, in case where the binary switch 57*a* is "1" in which the standard tension value To of the weft yarn 11 is to be set, a discrimination is made as to whether a new one of the standard tension value To is to be written (the writing switch : ON) after the presently set value is displayed. When written, the value set by the three decimal switches 57*b* is written in the RAM 63 to be memorized. That is to say, in order to set the standard tension value To, it is sufficient that the binary switch 57*a* is set to be "1"; the standard tension is set, for example, at "500" representing 50*g* by the decimal switches 57*b*;** and the writing switch is switched ON.

In order to set the allowable limit value LM, it is sufficient that the binary switch **57*a* is set to be "2"; the decimal switches 57*b* are set, for example, at 10; and the writing switch is switched ON. In order to set the pressure upper limit value Va, it is sufficient that the binary switch 57*a* is set to be "3"; the value Va is set by the decimal switches 57*b*; and the writting switch is switched ON. In order to set the pressure lower limit value Vb, it is sufficient that the binary switch 57*a* is set to be "4" and then a similar procedure to the case of setting the pressure upper limit value Va is carried out. In order to set the initial pressure value V, it is sufficient that the binary switch 57*a* is set to be "5"; the value V of the pressure is set by the decimal switches 57*b*; and the writing switch is switched ON. Additionally, in order to set a detection time M in which the signal from the weft tension detector 53 is detected, it is sufficient that the binary switch 57*a* is set to be "6"; the value (for example, 0.7 ms) of the time M is set by the decimal switches 57*b*;** and the writing switch is switched ON.

Subsequently, when the operation switch of the loom is switched ON, the pick number SP from the loom operation starting is judged (See a step S4). Until the pick number SP has reached two, a discrimination is made as to whether there is a signal from the proximity switch or not (See a step S5). In case where there is the signal, the pick number SP is counted up (See a step S6), standing ready to become three. Thus, until the pick number SP has reached two, the pressure control and reading the informations therefor are not carried out, merely standing ready for the stable revolution of the loom.

After the pick number SP has reached three, the weft tension value T is read through the signal from the weft tension detector 53 when the weft yarn 11 is brought into engagement with the engaging pin 29 at the time weft flight or travel terminates. More specifically, referring to FIG. 21, the winding-off detector 80 detects the fourth passage of the weft yarn to produce the fourth wind-off signal. Then, the weft tension is read in accordance with the signal from the weft tension detector 53 during the predetermined time period M from the time of production of the fourth wind-off signal, in which a peak value T is held (See steps S7 to S9). The peak value T is read as the weft tension T, and then a subtraction of the standard tension value To from the weft tension value T is carried out to obtain the difference $(T-To)$ therebetween, and the accumulating value $\Sigma(T-To)$ of a plurality of such differences is calculated. Simultaneously, the value of the $\Sigma P$ indicating the number of picks from the starting of such an accumulation is increased by one (See a step S10).

Next, a discrimination is made as to whether the accumulated value $\Sigma(T-To)$ of the differences $(T-To)$ exceeds the allowable limit LM (for example, $\pm 10$) on the plus or minus sides or not (See Steps S11 and S12). In case of exceeding the plug side allowable limit LM, the present pressure value (or the previously set initial pressure value) V is divided by the pick number $\Sigma P$ (for example, 10) before exceeding the allowable limit LM. The thus obtained divided value is subtracted from the present pressure value V thereby to set a new pressure value V (See a step S13). Subsequently, the thus set pressure value V is compared with the lower limit value Vb (See a step 14), and set as a lower limit value Vb in case of being smaller than the lower limit value Vb (See a step S15). In case of exceeding the minus side allowable limit LM, the present pressure value V is divided by the pick number ΣP before exceeding the allowable limit LM. The thus obtained divided value is added to the present pressure value V thereby to set a new pressure V (See a step S16). Subsequently, the thus set the pressure V is compared with the upper limit value Va (See a step S17), and set as an upper limit value Va in case of being larger than the upper limit value Va (See a step 18). The thus newly set pressure V is output to the D/A converter 52, and also displayed in the display section 60. Simultaneously, Σ(T−To) and ΣP are cleared (See a step S19).

Thus, in case where the accumulated value of the differences between the detected value and the standard value of the weft tension exceeds the plus side allowable limit, the weft tension is too large and therefore the pressure V to be supplied to the main nozzle 16 is lowered by an amount corresponding to the pick number required before exceeding the allowable limit, thereby weakening the traction force of air ejected from the main nozzle 16. This decreases the weft tension at the time of the flight termination of the weft yarn, thus maintaining the weft tension at a constant value. On the contrary, in case where the accumulated value exceeds the minus side allowable limit, the weft tension is too small and therefore the pressure V to be supplied to the main nozzle 16 is raised by an amount corresponding to the pick number required before exceeding the allowable limit, thereby enlarging the traction force of air ejected from the main nozzle 16. This increases the weft tension at the time of the flight termination of the weft yarn, thus maintaining the weft tension at a constant value. It will be understood that supply of the previous pressure V to the main nozzle 16 is continued in case where the accumulated value of the differences between the detected value and the standard value of the weft tension does not exceed the allowable limits. Additionally, in case where the operation switch is switched OFF, the pick number SP from the loom operation starting is cleared (See a step S20), and then standing ready is made.

Figure 22:
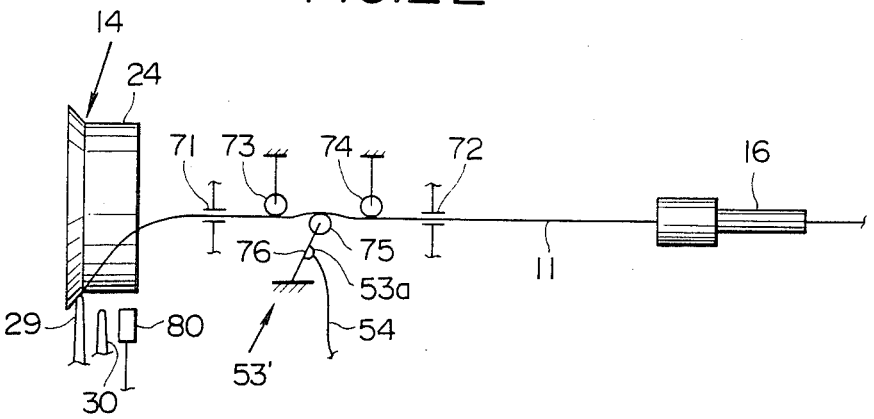
FIG. 22 is a schematic illustration similar to FIG. 8 but showing a fourth embodiment of a loom of the present invention.

FIG. 22 illustrates a fourth embodiment of the loom of the present invention which is similar to the embodiment of FIG. 8 with the exception that the wind-off detector 80 is provided to detect the passage of the weft yarn 11 wound off from drum 24. Accordingly, the signals from the strain gauge 53*a* and from the wind-off detector 80 are input to the control circuit 51, so that the tension of the weft yarn 11 can be controlled at a constant value in the same manner as in the embodiment of FIGS. 12 to 18.

While the control of the tension of the weft yarn 11 has been shown and described as being carried out by regulating the air pressure to be supplied to the main nozzle 16, it will be understood that the same weft tension control may be carried out by regulating the revolution speed of the loom main shaft in which increasing the revolution speed shortens the weft picking time period (the time period in which a fluid acts on the weft yarn) thereby to reduce the weft tension; while decreasing the revolution speed prolongs the weft picking time period thereby to enlarge the weft tension, thus converging the weft tension to a constant value. Otherwise, such a weft tension control may be carried out by regulating the pressure to be supplied to auxiliary nozzles (not shown) arranged on a row along the weft passage through which the weft yarn travels or is picked.

As will be appreciated above, according to the above-discussed embodiments, the weft tension can be effectively controlled to a constant value even if the tension applied to the weft yarn is different for each weft package, thus obtaining high quality woven cloths. Additionally, by virtue of controlling the weft tension at the constant value, high speed loom operation can be effectively achieved without causing weft cutting by setting a standard value of the weft tension at a limit value over which strip-back (weaving defect due to filament cutting) occurs. Furthermore, energy saving can be effectively achieved without causing mispick by setting the standard value to a limit value over which kink is caused.

Figure 23:
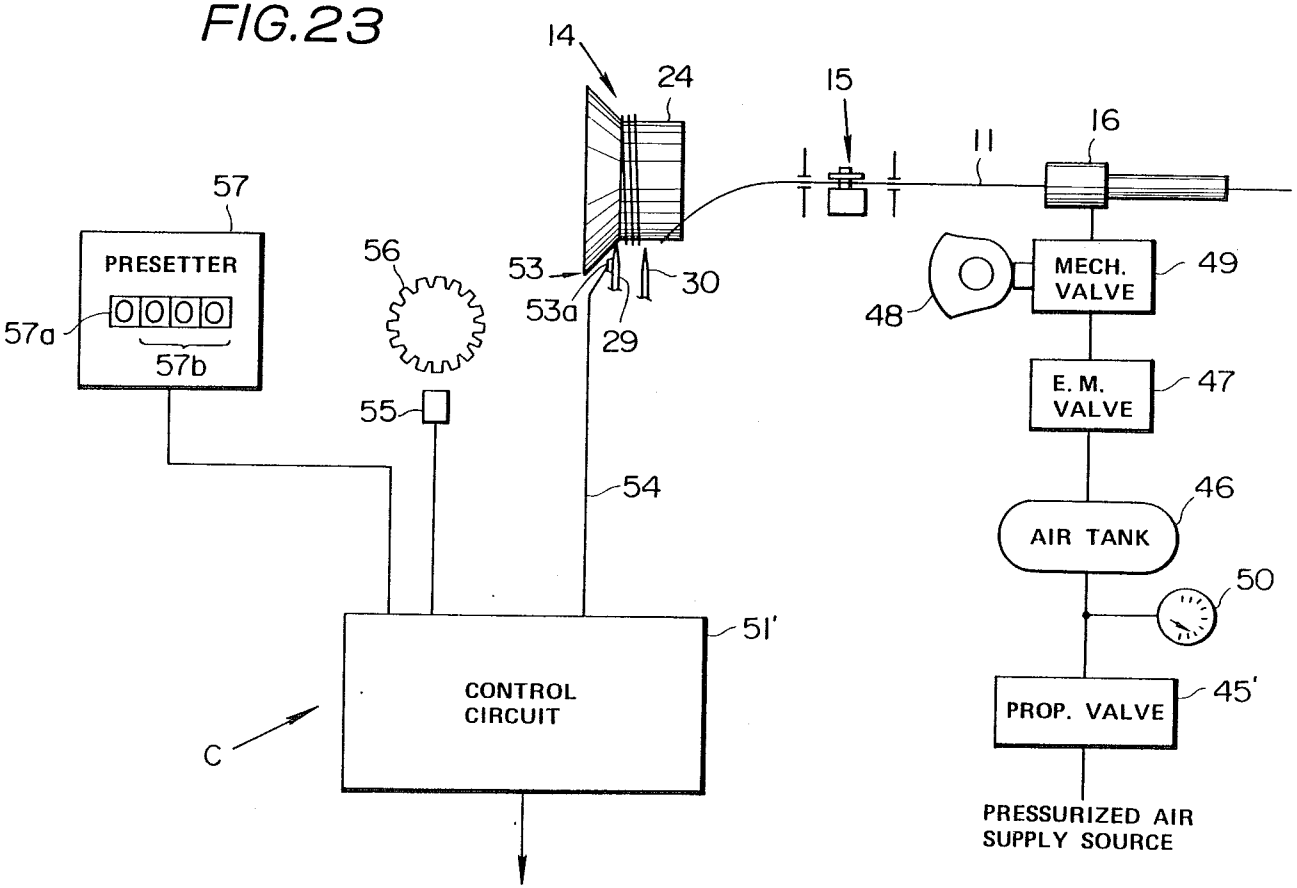
FIG. 23 is a schematic illustration similar to FIG. 4 but showing a fifth embodiment of a loom of the present invention including a control system for the loom.
Figure 24:
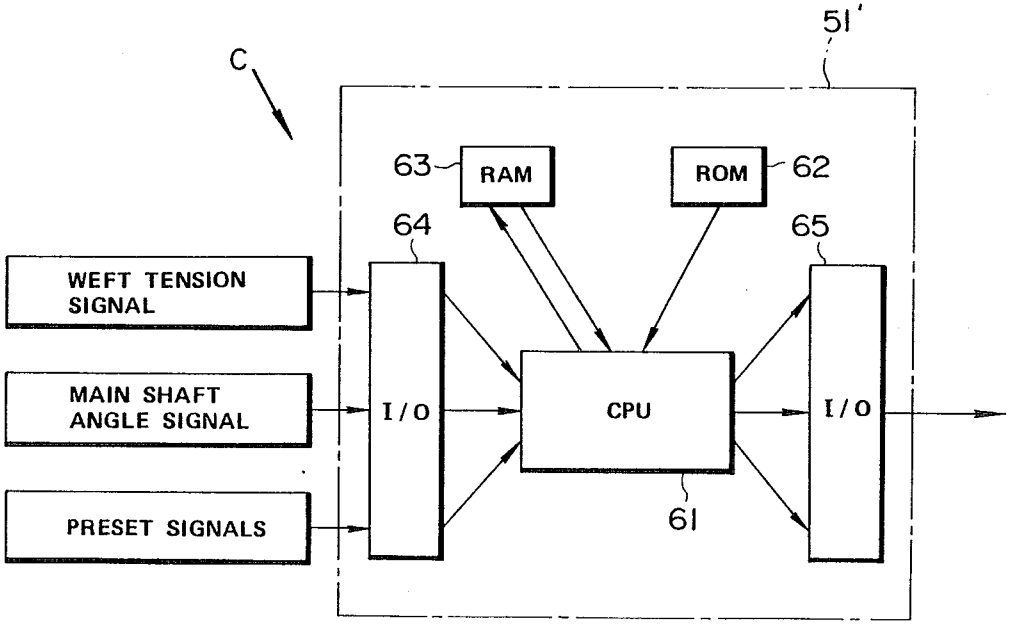
FIG. 24 is a block diagram of a hardware arrangement of a control circuit forming part of the control system of FIG. 23.

FIGS. 23 and 24 illustrate a fifth embodiment of the loom of the present invention which has a function to detect as to whether weft picking has been normally carried out upon sensing the flight force or speed of the picked weft yarn 11. This embodiment is similar to the embodiment of FIGS. 1 to 5 with the exception tha a pressure regulator valve 45' is used in place of the electric signal-air pressure proportion valve 45. In this embodiment, the weft tension detector 53 is used as a weft flight force detector. As seen from FIG. 23, the signals from the weft tension detector 51, the angle sensor 55, and the presetter 57 are input as control input to the control circuit 51' which is adapted to carry out a predetermined processing in accordance with the control inputs from the weft tension detector 51, the angle sensor 55 and the presetter 57 thereby to accomplish the detection of the condition of the weft yarn 11.

As shown in FIG. 24, read through the I/O device 64 in the CPU 61 are the signal (representative of a tension value T of the weft yarn 11) from the weft tension detector 53, the signal (representative of the main shaft angle) from the angle sensor 55, and the signal (representative of a standard tension set value To of the weft yarn) etc. from the presetter 57. Necessary data are written in the RAM 63 and read out from the RAM 63 in accordance with the program of the ROM 62, and a weft picking abnormality signal (representative of, for example, a condition no weft yarn is detected) is output to a loom operation stopping circuit (not shown) for stopping loom operation or the like, if necessary.

Figure 25A:
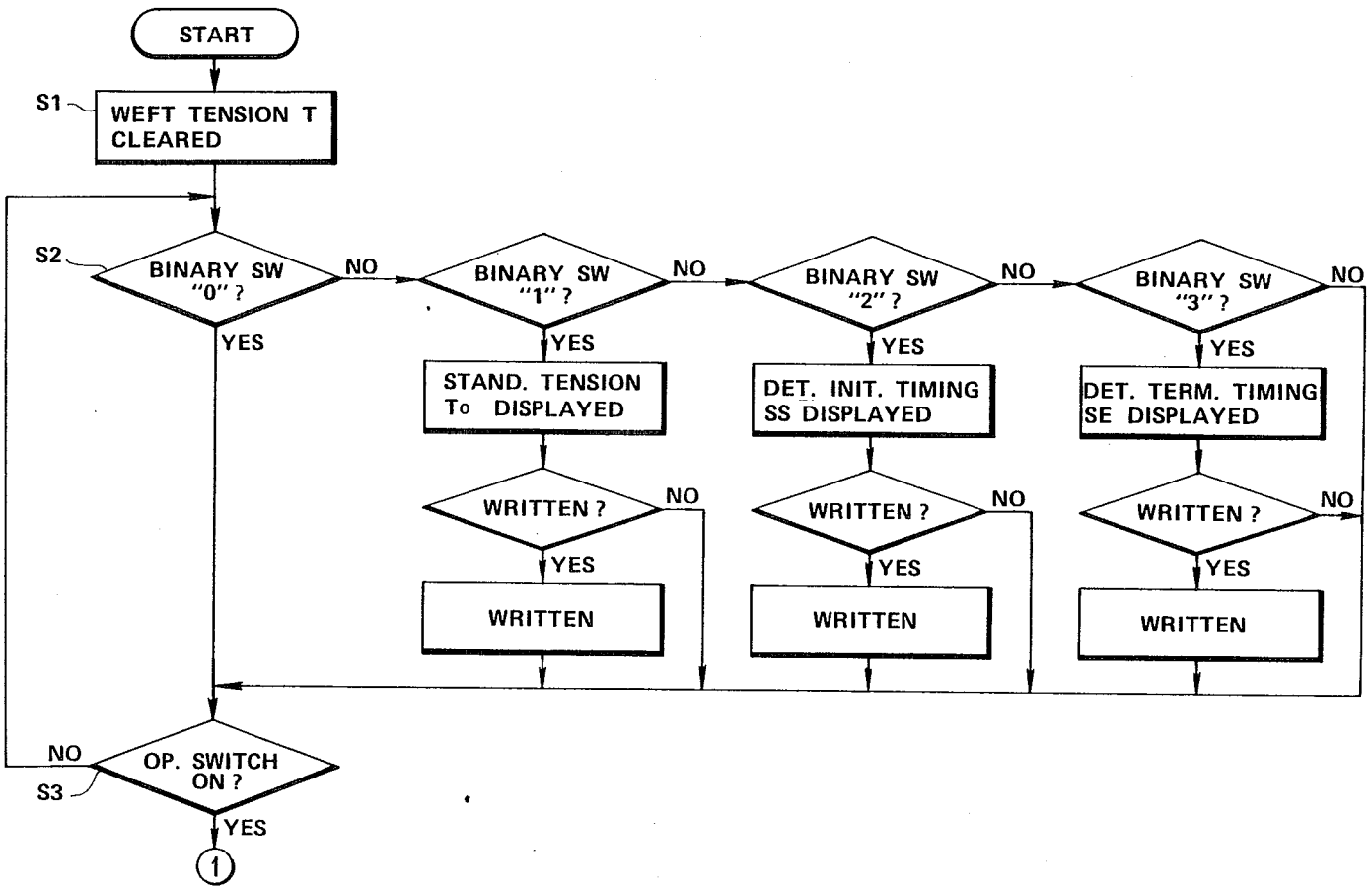
FIGS. 25A and 25B are flow charts showing the procedure of the control of the control system of FIG. 23.
Figure 25B:
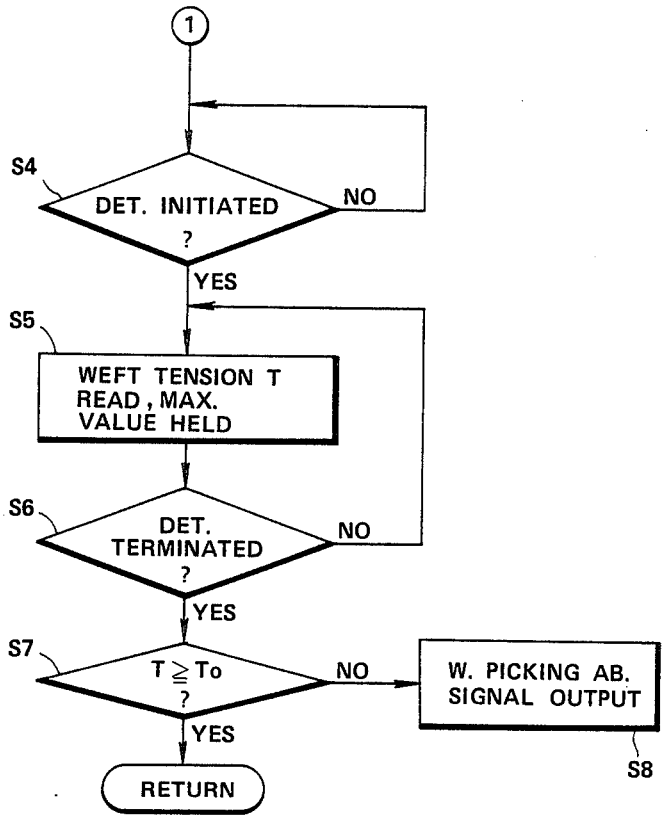

The operation of the loom shown in FIGS. 23 and 24 will be discussed hereinafter with reference to FIGS. 25A and 25B.

When the loom is electrically connected to an electric source, the memorized value of the weft tension T is cleared (See a step S1). Subsequently, a discrimination is made as to whether a reading condition of the informations from the presetter 57 (the binary switch : other than "0") has been reached or not (See a step S2). In case where a condition is to be newly set or changed in the reading condition, the condition to be set is input from the presetter 57. More specifically, in case where the binary switch 57*a* of the presetter 57 is "0", a discrimination is immediately made as to whether the operation switch of the loom has been switched ON (See a step S3). However, in case where the binary switch 57*a* is "1" in which the standard tension value To of the weft yarn 11 is to be set, a discrimination is made as to whether a new one of the standard tension value To is to be written (the writing switch: ON) after the presently set value is displayed in a displaying device (not shown). When written, the value set by the three decimal switches 57*b* is written in the RAM 63 to be memorized. That is to say, in order to set the standard tension value To, it is sufficient that the binary switch 57*a* is set to be "1"; the standard tension is set, for example, at "500" representing 50.0 g by the decimal switches 57*b;* and the writing switch is switched ON.

In order to set a detection initiation timing SS at which the detection of weft tension is initiated, it is sufficient that the binary switch 57*a* is set at "2"; the decimal switches 57*b* are set at "230" representing 230°; and the writing switch is switched ON. Additionally, in order to set a detection termination timing SE at which the detection of weft tension is terminated, it is sufficient that the binary switch 57*a* is set at "3"; the decimal switches 57*b* are set at the value representing the detection termination timing; and the writing switch is switched ON.

Subsequently, when the operation switch of the loom is switched ON, a discrimination is made as to whether the detection initiation timing SS for the weft tension has come or not (See a step S4). On the stage where the detection initiation timing SS has come, reading the signals from the weft tension detector 53 is initiated and repeated until the detection termination timing SE of the weft yarn is judged to have come, holding the maximum value of the weft tension (See steps 5 and 6). More specifically, during a time period including a time at which the weft yarn 11 is brought into engagement with the engaging pin 29 at the flight or travel termination of the weft yarn 11, the signals from the weft tension detector 53 are read to memorize the signal at the maximum value, thereby obtaining the weft tension T at the time the weft yarn 11 is finally brought into engagement with the engaging pin 29 at the flight termination of the weft yarn 11.

The thus obtained weft tension T at the weft yarn flight termination is compared with the standard tension To (See a step S7). In case of $T \geqq To$, a judgement is made as to be normal in weft picking in which there is a weft yarn, so that the procedure in the flow charts is repeated. In case of $T < To$, a judgement is made to be abnormal in weft picking in which there is no weft yarn, thereby outputting the weft picking abnormality signal in order to operate the loom operation stopping circuit or the like.

Here, the above-mentioned procedure leads to detection of the picked weft yarn by the following reasons: The tension of the weft yarn 11 is proportional to flight or travel speed of the weft yarn 11 and to the mass of the weft yarn 11. It will be understood that the flight speed of the weft yarn 11 is almost constant because the traction force of air from the main or weft inserting nozzle 16 is constant in this case. Accordingly, a variable component of the tension of the weft yarn 11 is considered to be the mass of the weft yarn 11. It is to be noted that a synthetic fiber yarn such as a filament yarn is considered to have a nearly constant mass per unit length, so that the tension of the weft yarn is proportional to the length of the picked weft yarn, i.e., the length of the weft yarn 11 which has been travelled until the weft yarn is brought into engagement with the engaging pin 29. This leads to the fact that in case where the tip end section of the weft yarn 11 is caught by the warp yarn 2, the length of the travelling weft yarn 11 is short as compared with in the case where normal weft picking is accomplished, so that the tension of the weft yarn 11 is lowered below the standard tension To. Thus, the detection of the weft yarn 11 is achieved under such a principle. Additionally, in case where the flight speed of the weft yarn changes in accordance with the amount of weft yarn wound on a yarn supply member depending on the kind of yarns, the principle of the above-discussed embodiment and the operation shown in FIGS. 23 to 25B may be used in combination with the idea of the embodiments of FIGS. 1 to 7. It will be understood that the principle of the embodiment and the operation of FIGS. 23 to 25B is applicable to the arrangement shown in FIG. 7 in which the strain gauge 53*a* forming part of the weft tension detector 53 is located on the elongated support member 76 for the roller 75 in contact with the picked weft yarn 11.

Figure 26:
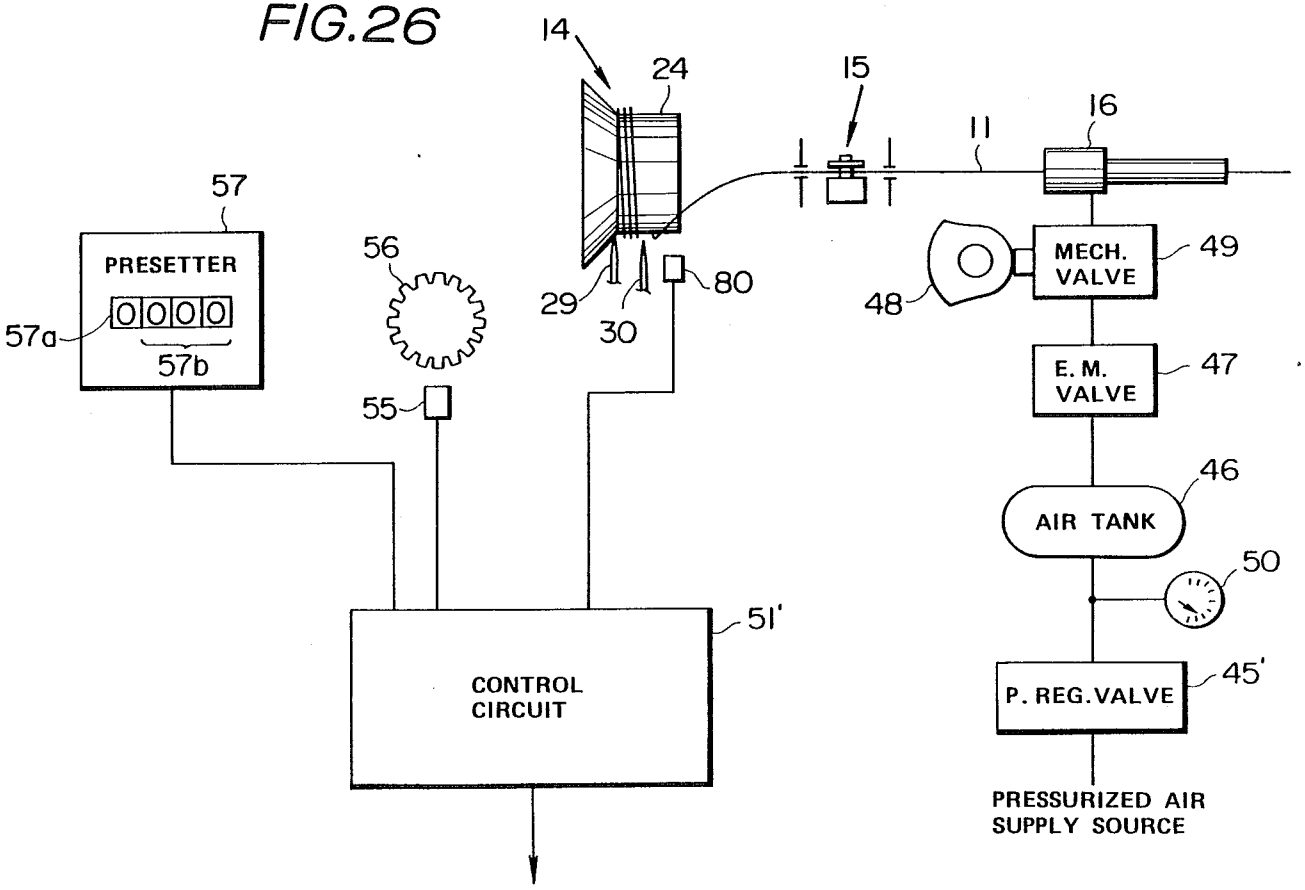
FIG. 26 is a schematic illustration similar to FIG. 4 but showing a sixth embodiment of the loom of the present invention including a control system for the loom.

FIG. 26 illustrates a sixth embodiment of the loom of the present invention which is similar to the embodiment of FIGS. 23 and 24 with the exception that the wind-off detector 80 is used as the weft flight force detector in place of the weft tension detector 53. In this embodiment, the wind-off detector 80 is the same as in the embodiment of FIGS. 12 to 18, so that the arrangement of the wind-off detector 80 and the drum 24 is the same as that shown in FIGS. 15 to 17. Assuming that the weft yarn 11 is being wound four times on the drum 24 as an amount corresponding to one weft picking, a detection signal is obtained per one time wind-off of the weft yarn 11 from the drum 24, so that four detection signals are obtained until the weft picking terminates. It is to be noted that the fourth detection signal of the four detection signals is used as the wind-off signal.

In this embodiment, the wind-off signal from the wind-off detector 80, the signal from the angle sensor 55, and the signals from the presetter 57 are input as control inputs to the control circuit 51' which makes a predetermined processing in accordance with the control inputs from the wind-off detector 80, the angle sensor 55, and the presetter 57, thus accomplishing the detection of the weft yarn 11. The control circuit 51' has a hardware arrangement same as that shown in FIG. 24 but has a different software arrangement.

Figure 27:
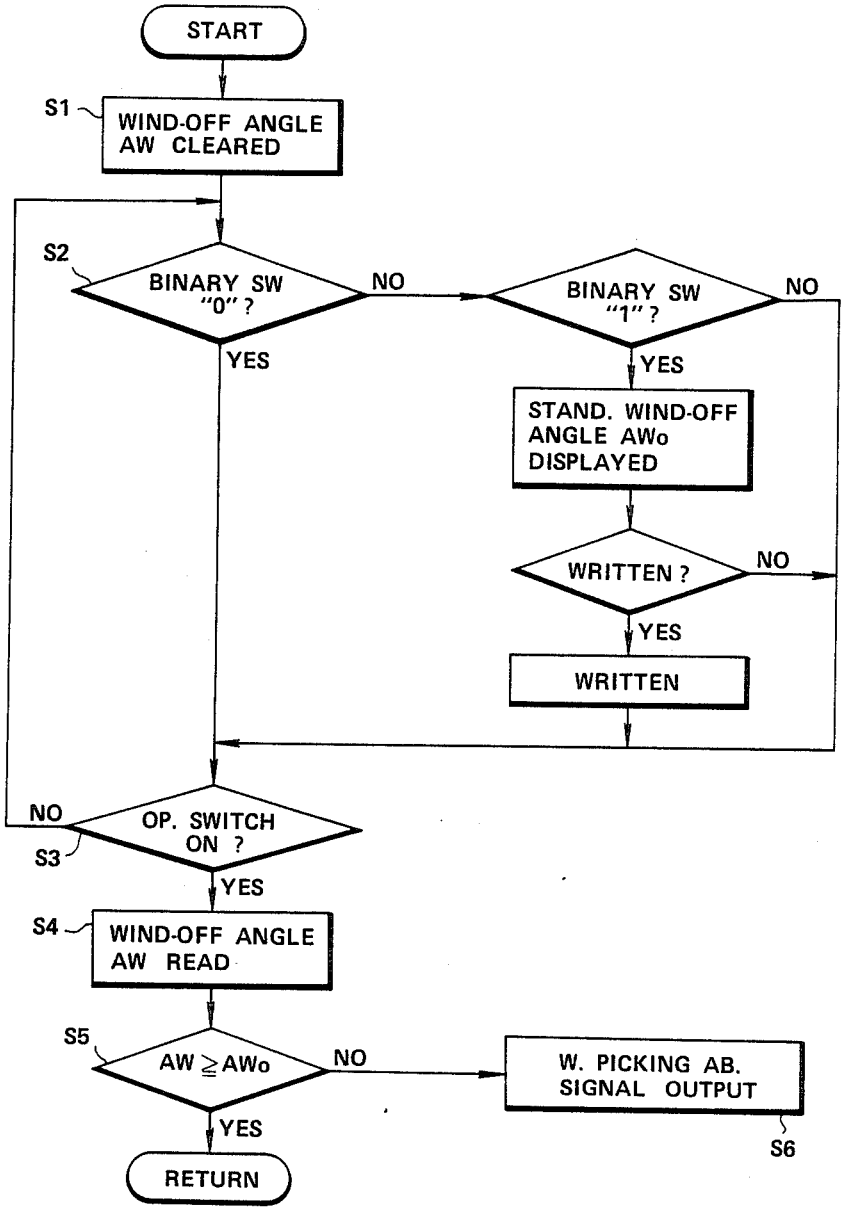
FIG. 27 is a flow chart showing the procedure of the control of the control system of FIG. 26.

The operation of the configuration of the loom of FIG. 26 will be discussed with reference to FIG. 27.

When the loom is first electrically connected to an electric source, the memorized value of a wind-off angle (the loom main shaft angle at the time the fourth wind-off signal is obtained) AW is cleared (See a step 1). Subsequently, a discrimination is made as to whether a reading condition (the binary switch 57*a:* other than "0") for the informations from the presetter 57 has been reached or not (See a step 2). In case of the reading condition in which conditions are to be newly set, the conditions are input through the presetter 57. More specifically, for example in case where the binary switch 57*a* of the presetter 57 is "0", a discrimination is immediately made as to whether the loom operation switch is switched ON or not (See a step 3). In case where the binary switch 57*a* is "1" in which a standard wind-off angle AWo is to be set, a discrimination is made as to whether a new one of the wind-off angle AWo is to be written (the writing switch: ON) or not after the presently set value is displayed. When written, the value set by the three decimal switches 57*b* is written in the RAM to be memorized. That is to say, in order to set the standard wind-off angle AWo, it is sufficient that the binary switch 57*a* is set at "1"; the decimal switches 57*b* are set, for example, at "250" representing 250°; and the writting switch is switched ON.

Subsequently, when the loom operation switch is switched ON, the main shaft angle signal or wind-off angle AW at the time the fourth wind-off signal is input during the weft yarn 11 being wound off from the drum 24 at the weft picking (See a step 4). This wind-off angle AW is compared with the standard wind-off angle AWo (See a step 5). In case of AW≧AWo, a judgement is made to be normal in weft picking (there is a weft yarn) thereby to repeat the procedure of the flow chart of FIG. 27. In case of AW<AWo, a judgement is made to be abnormal in weft picking (there is no weft yarn) thereby to output the weft picking abnormality signal while operating the loom operation stopping circuit or the like (See a step 6).

Thus, when the tip end section of the weft yarn 11 is caught by the warp yarn 2, the length of the weft which has finally travelled becomes small so that the mass of the weft yarn is decreased by an amount corresponding to the minimized length. Accordingly, the inertia applied to the weft yarn 11 is minimized, so that a wind-off timing at which a predetermined length of the weft yarn is wound off from the drum 14 is delayed. This accomplishes the judgement as to whether the weft picking is carried out normally or abnormally.

What is claimed is:

1. A loom comprising:

means for picking a weft yarn along a weft passage, said weft picking means including a weft inserting nozzle by which said weft yarn is picked under the influence of a jet of fluid supplied thereto;

means for detecting force of said weft yarn at a time in the vicinity of termination of travel of said weft yarn in weft picking, said force detecting means comprising means for detecting tension of said weft yarn at aid time;

means for comparing said weft yarn force with a standard force of said weft yarn to obtain any difference therebetween, said force comparing means comprising means for comparing said weft yarn tension with a standard tension of said weft yarn to obtain a difference in tension therebetween; and means for controlling said tension applied to said weft yarn, said tension controlling means comprising means for controlling said fluid to be supplied to said nozzle in accordance with said difference in tension.

2. A loom as claimed in claim 1, wherein said tension controlling means is constructed and arranged to control revolution speed of a main shaft of the loom, weaving operation of the loom being in timed relation to the revolution speed of said loom main shaft.

3. A loom as claimed in claim 1, further comprising weft storage means for storing a predetermined length of said weft yarn prior to weft picking, said weft sotrage means including a drum on which said weft yarn is wound to be stored, and an engaging pin movable relative to said drum in such a manner that the travel of said weft yarn terminates upon engaging with said engaging pin.

4. A loom as claimed in claim 3, wherein said force detecting means is means for detecting force in flight of said weft yarn at said time, in which said force comparing means is means for comparing said weft yarn flight force with a standard flight force of said weft yarn to obtain a discrepancy in flight force therebetween, in which said force controlling means includes means for outputting a signal representative of abnormality in weft picking in accordance with said discrepancy in flight force.

5. A loom as claimed in claim 4, wherein said flight force detecting means includes a tension sensor element disposed to sense the tension of said weft yarn and produce a first signal representative of the tension of said weft yarn.

6. A loom as claimed in claim 5, wherein said flight force comparing means is constructed and arranged to compare level of said first signal with a predetermined level representative of a standard tension of said weft yarn, in which said signal outputting means is constructed and arranged to output a second signal representative of abnormality in weft picking upon said first signal level being lower than said predetermined level.

7. A loom as claimed in claim 4, wherein said force detecting means is weft wind-off detecting means for detecting passage of said weft yarn wound from said drum during the travel of said weft yarn in weft picking and producing a first signal representative of timing of wind-off of said weft yarn from said drum.

8. A loom as claimed in claim 7, wherein said flight force comparing means is constructed and arranged to compare timing of production of said first signal with a signal representative of a predetermined timing level, in which said signal outputting means is constructed and arranged to output a second signal representative of abnormality in weft picking upon said production timing of said first signal being later than said predetermined timing.

9. A loom as claimed in claim 3, wherein said tension detecting means includes a tension sensor element disposed to sense the tension of said weft yarn and produce a signal representative of weft yarn tension.

10. A loom as claimed in claim 9, wherein said tension sensor element is secured to said engaging pin to sense deflection of said engaging pin and produce a first signal representative of the deflection of said engaging pin.

11. A loom as claimed in claim 10, wherein said tension sensor element is a strain gauge.

12. A loom as claimed in claim 11, wherein said tension comparing means is constructed and arranged to compare level of said first signal with a predetermined level representative of a standard tension of said weft yarn to output a second signal representative of a difference therebetween, in which said tension controlling means includes a pressure control valve for controlling air pressure to be supplied to said weft inserting nozzle in accordance with said difference.

13. A loom as claimed in claim 9, wherein said tension sensor element is secured to an elongate support member for rotatably supporting a roller contactable with said weft yarn in weft picking.

14. A loom as claimed in claim 9, wherein said engaging pin includes first and second pin sections which are separate at least a portion thereof from each other so that said first and second pin sections are different in deflection from each other, said first pin section being located on side of said weft inserting nozzle and upstream in a direction in which said weft yarn is wound off on said drum, relative to said second pin section, said first pin section being provided with said tension sensor element.

15. A loom as claimed in claim 14, wherein said first pin section having a first end separate from said second pin section and a second end integral with said second pin section.

16. A loom as claimed in claim 3, wherein said tension detecting means includes a tension sensor element to sense the tension of said weft yarn and produce a first signal representative of the tension of said weft yarn.

17. A loom as claimed in claim 16, further comprising weft wind-off detecting means for detecting passage of said weft yarn wound off from said drum during the travel of said weft yarn in weft picking and producing ,a second signal, and peak level detecting means for detecting a peak level of said first signal within a predetermined time period from production of said second signal and including a timing of termination of the travel of said weft yarn in weft picking.

18. A loom as claimed in claim 17, wherein said tension comparing means is constructed and arranged to compare said peak level with a predetermined level representative of a standard tension of said weft yarn and produce a third signal representative of a difference therebetween, in which said tension controlling means includes a pressure control valve for controlling air pressure to be supplied to said weft inserting nozzle in accordance with said difference.

19. A loom as claimed in claim 18, wherein said tension sensor element is secured to said engaging pins in which said first signal is representative of the deflection of said engaging pin upon said weft yarn being brought into engagement with said engaging pin in weft picking.

20. A loom as claimed in claim 18, wherein said tension sensor element is secured to an elongate support member for rotatably supporting a roller contactable with said weft yarn in weft picking.

21. A loom as claimed in claim 17, wherein said weft wind-off detecting means includes a bunch of optical fibers having light casting and receiving faces which spacedly face to the surface of said drum, and means defining a mirror face on the surface of said drum, the light casting and receiving faces of said optical fibers being faceable to said mirror face.

22. A loom as claimed in claim 1, wherein a part of said tension detecting means is disposed between said weft inserting nozzle and means for measuring a predetermined length of said weft yarn to be used for each weft picking.

23. A loom comprising:

means for picking a weft yarn along a weft passage, said weft picking means including a nozzle by which said weft yarn is picked under the influence of a jet of fluid supplied thereto;

means for detecting force of said weft yarn at a time in the vicinity of termination of travel of said weft yarn in weft picking, said force detecting means comprising means for detecting tension of said weft yarn at said time;

means for comparing said weft yarn force with a standard force of said weft yarn to obtain any difference therebetween, said force comparing means comprising means for comparing said weft yarn tension with a standard tension of said weft yarn to obtain a difference in tension therebetween; and means for controlling said tension applied to said weft yarn, said tension controlling means comprising means for controlling said fluid to be supplied to said weft inserting nozzle in accordance with said difference in tension.

* * * * *